US007553149B2

(12) United States Patent
Tagliati et al.

(10) Patent No.: US 7,553,149 B2
(45) Date of Patent: Jun. 30, 2009

(54) ISOSTATIC DIE FOR TILE FORMING

(75) Inventors: Daniele Tagliati, Fiorano Modenese (IT); Davide Tagliati, Fiorano Modenese (IT); Michele Tagliati, Fiorano Modenese (IT)

(73) Assignee: TA-RO Progetti S.N.C., Fiorano Modenese (Modena) (IT)

( * ) Notice: Subject to any disclaimer, the term of this patent is extended or adjusted under 35 U.S.C. 154(b) by 160 days.

(21) Appl. No.: 11/778,248

(22) Filed: Jul. 16, 2007

(65) Prior Publication Data

US 2008/0026092 A1 Jan. 31, 2008

(30) Foreign Application Priority Data

Jul. 26, 2006 (IT) ..... RE2006A0091
Nov. 30, 2006 (IT) ..... RE2006A0146

(51) Int. Cl.
*B28B 3/00* (2006.01)
*B30B 5/02* (2006.01)

(52) U.S. Cl. ..... 425/405.2; 425/419; 425/423; 425/DIG. 19

(58) Field of Classification Search ..... 425/405.1, 425/405.2, 412, 419, 423, 812, DIG. 19
See application file for complete search history.

(56) References Cited

U.S. PATENT DOCUMENTS 4,133,626 A * 1/1979 Schubart ..... 425/405.2
4,518,341 A * 5/1985 Suffa ..... 425/405.2
6,004,126 A 12/1999 Strobel

FOREIGN PATENT DOCUMENTS

EP 1297934 A 4/2003
FR 2673566 A 9/1992

* cited by examiner

*Primary Examiner*—Yogendra Gupta
*Assistant Examiner*—Thu Khanh T Nguyen
(74) *Attorney, Agent, or Firm*—Browdy and Neimark, P.L.L.C.

(57) ABSTRACT

An isostatic die for tile forming comprising a metal body (2) and an elastically deformable membrane (6, 6', 6") which is solidly gripped to the metal body (2) in a plurality of distinct predetermined fixing zones (25, 28, 290, 21, 22, 24', 24"), such that an intermediate hermetically sealed chamber is delimited between the elastic membrane (6, 6', 6") and the metal body (2), which chamber is destined to contain an incompressible fluid. Rigid bushings (5, 5") are sunk into the elastic membrane (6, 6', 6"), each of which rigid bushings (5, 5") is located at a fixing zone (25, 28, 290, 21, 22, 24', 24") of the elastic membrane (6, 6', 6") to the metal body (2), and defines a breather mouth lo (52) which passes into a body of the elastic membrane (6, 6', 6") and which communicates with an outside environment through a system of discharge conduits (9) afforded in the metal body (2), each rigid bushing (5, 5") receiving a respective obturator body (7), which obturator body (7) enables passage of air and at least partially prevents passage of ceramic powder.

23 Claims, 18 Drawing Sheets

ISOSTATIC DIE FOR TILE FORMING

The invention relates to dies for forming ceramic tiles and, more in particular, an isostatic die destined to be associated to forming cavities of one or more dies.

As is known, usual ceramic dies comprise a forming cavity for containing the powder ceramic material, which cavity is delimited by a lateral containing matrix in which a bottom die is slidable received, which bottom die collaborates with a top die in order to coin the flat opposite surfaces of the tile.

The pressing operation often leads to producing a defective finished tile, sometimes gravely defective, the problems depending on various factors. One of these factors is the irregular distribution of the ceramic powders internally of the forming cavity of the die, which is manifested in a non-homogeneous density in the unfired tile.

This lack of homogeneity leads to differentiated heat dilation in the tile during the firing stage and corresponding uneven shrinkage during the cooling stage, which cause various size, shape and planarity defects, sometimes even resulting in breakage and/or cracking.

To obviate this problem, the technical field offers the use of dies known as isostatic.

Isostatic dies comprise a metal body provided with an active surface destined to face towards the inside of the die forming cavity.

The active surface is provided with a concentric cavity which is superiorly closed by an elastic membrane, which is anchored to the metal body at a plurality of predetermined zones and which is destined to contact the mass of ceramic powders in order to coin one of the flat surfaces of the tile.

The above-mentioned concentric cavity is filled with an incompressible fluid under pressure, which inflates the elastic membrane at the zones in which the membrane is not anchored to the metal body, giving the membrane an overall lumpy appearance.

During pressing, the zones of the elastic membrane which act where there is a greater density of ceramic powders are squeezed and push the incompressible fluid so that it more greatly inflates the zones where there is a lower density of the material.

In this way the pressure the membrane applies to compact the mass of ceramic powders is constant and the density of the tile being pressed is therefore homogeneous.

However, during the closure of the die the air contained in the forming cavity must necessarily flow towards the outside.

In the ceramics sector this stage is usually called the degassing stage, and it is necessary in order to prevent grave defects from appearing in the finished ceramic product, deriving from the presence of residual trapped air in the pressed unfired tile.

These defects, which can often be identified only in a relatively advanced stage of tile production, can lead to a total rejection of the product with obvious economic losses.

During the degassing stage, the flow of air is generally directed from the centre of the forming cavity towards the periphery thereof, where it exits by passing into the space (usually a few tenths of millimeters) between the edge of the dies and the lateral containing matrix.

A current of air is thus established, which causes a displacement of the ceramic powders, which then accumulate at the sides of the forming cavity and become less concentrated in the centre of the cavity.

For this reason, the central zones of the elastic membrane of the isostatic die are, at each cycle, inflated more than the peripheral zones, which leads to their very rapid deterioration.

In particular, this phenomenon is very relevant in isostatic dies for realising large-format tiles, where the degassing of the forming cavity produces, especially if done at too-fast speeds, differences of powder distribution so accentuated that they can even cause explosion and breakage of the elastic membrane. A further drawback in pressing ceramic tiles is therefore the time required to make sure that all the air present in the forming cavity completely exits, thus achieving perfect degassing.

This means considerably slowing down the die closure time, or sub-dividing the pressing operation into two successive stages, introducing a pause in work which negatively influences plant productivity.

A further drawback consists in the fact that the wear on the ceramic dies is mainly determined by the already-mentioned flow of degassing air, which, being concentrated between the edges of the dies and the containing matrix, lo means replacing these components even if they are only worn at their peripheral parts.

The aim of the invention is at least partially to obviate the above-described drawbacks.

In particular, an aim is to prevent the air in the forming cavity from remaining imprisoned inside the pressed tiles, thus simultaneously avoiding deterioration and/or explosion of the elastic membrane, the rapid wearing of the ceramic dies, and increasing plant productivity.

A further aim of the invention is to attain these objectives while providing a solution which is simple, rational and inexpensive.

The aim is attained by the invention as it is characterized in the appended claims.

In particular, an isostatic die is provided which comprises a metal body and an elastically deformable membrane which is solidly constrained to the metal body at a plurality of distinct predetermined fixing zones, such that a hermetically-sealed intermediate chamber is delimited between the elastic membrane and the metal body, which intermediate chamber can contain an incompressible fluid.

According to the invention, rigid bushings are sunk into the elastic membrane, each of which bushings defines a breather mouth, having predetermined dimensions and being substantially non-deformable, which mouth is sunk into the thickness of the elastic membrane and communicates with the outside through a system of discharge conduits afforded in the metal body.

Each rigid bushing is located at a fixing zone of the elastic membrane to the metal body, such as not to compromise the seal of the incompressible fluid chamber, enabling correct functioning of the isostatic compensating pressing system.

Further, as the fixing zones of the elastic membrane do not deform during pressing, the rigid bushings are not subject to undesired displacement which might compromise communication of the breather mouths with the system of discharge conduits, which guide the air towards the outside.

According to the invention, each single rigid bushing receives a respective obturator body, which enables passage of the air and at least partially prevents passage of the ceramic powder.

For example the obturator body can be constituted by a compact body conformed such as only partially to obstruct the relative breather mouth, leaving a thin fissure open having a size which lets the air through but limits to a minimum the amount of ceramic powder which can pass through.

Thanks to this solution, during the closure of the ceramic die, the air contained in the forming cavity can freely flow internally of the breather mouths and exit to the outside through the system of discharge conduits afforded in the metal body of the die.

The addition of the breather mouths thus considerably increases the overall surface of die through which the air can flow outwards (which in the prior art was limited to the perimeter fissure located between the die and the forming matrix), and effectively enables the air to exit also from the centre of the forming cavity, through the die tile-forming surfaces.

In this way, the flow of air from the centre towards the periphery of the forming cavity is eliminated or at least significantly reduced, which flow of air can cause undesired re-distribution of the ceramic powders and rapid wear of the die at its peripheral zones.

In a first embodiment of the invention, each obturator body is stably fixed to the metal body of the isostatic die, such as always to be stationary internally of the relative rigid bushing, preferably in a line with the die active face.

This embodiment further comprises the totality of the breather conduits being connected to a blower device, which is activated at the end of the pressing cycle to inject compressed air therein.

In this way, the compressed air injected into the discharge conduits will tend to exit from the breather mouths, projecting the ceramic powder which may be trapped inside the fissure left between the obturator bodies and the relative breather mouths towards the forming cavity.

Owing to these jets of air exiting from the breather mouths, the above-described solution can however exhibit the drawback of raising a large quantity of powder into the zones surrounding the ceramic die, making the surrounding environment unpleasant for the personnel.

To obviate this drawback a second and preferred embodiment of the invention is provided.

In the second embodiment, each obturator body slides internally of the relative rigid bushing, with an alternating motion in the direction of the bushing axis.

In particular, this embodiment comprises each obturator body being fixed to an end of a respective valve stem, which is activated to slide internally of a guide hole afforded in the metal body of the isostatic die, behind the relative rigid bushing.

Thanks to this solution, the obturator body is positioned in line with the active surface of the die during the pressing stage, and when the die opens, it is made to slide towards the inside of the forming cavity, such as to remove the powder which might be trapped in the fissure between the obturator body and the rigid bushing during the tile forming.

It can however occur that after repeated pressing cycles a certain quantity of ceramic powder invades the breather mouths and accumulates in the discharge conduits, obstructing them and preventing de-gassing of the forming cavity.

To prevent this from happening and causing a production halt of the ceramic die, the invention comprises the totality of discharge conduits being connected to a special aspirating device.

The aspirating device is activated each time the die has completed a relatively high number (which is however always compatible with the production requirements) of pressing cycles, such as to clean the discharge conduits by aspirating the ceramic powder contained therein.

Preferably the aspirating action of the aspirating device is added to by a similar blower device to the one used in the first preferred embodiment of the lo invention, but which injects compressed air at a generally lower pressure. The blower device is set in communication with the totality of the discharge conduits at different points with respect to the aspirating device, and injects air internally of the conduits in order to push the ceramic powder accumulated therein towards the mouth of the aspirating device itself.

At this point note that the solutions provided by the invention are also very well suited to use with an isostatic die equipped with an anti-transparency system.

The phenomenon of "transparency" consists in the fact that on the front surface (in view) of the tiles, there can remain a slight trace of the underlying feet of the laying surface, which causes the finished product to be classed as a second.

The above-described isostatic dies with anti-transparency system comprise a metal body in which a hollowed out part is afforded, having a grid plan shape in which a complementarily-shaped grid is housed which is more rigid than the elastic membrane, and which is interposed between the elastic membrane and the incompressible fluid chamber.

In these dies, the elastic membrane is strongly gripped to the metal body in the zones comprised between the links of the lowered grid, and a rigid bushing can be sunk at exactly those zones therein in order to realize the degassing system of the invention.

Further characteristics and advantages of the invention will better emerge from a reading of the following description, which is provided by way of non-limiting example with the help of the figures of the drawings, in which.

Figures from 1 to 7 show a die 1 destined to be associated to a ceramic press for coining a lower or laying surface of tiles.

Figure 4:
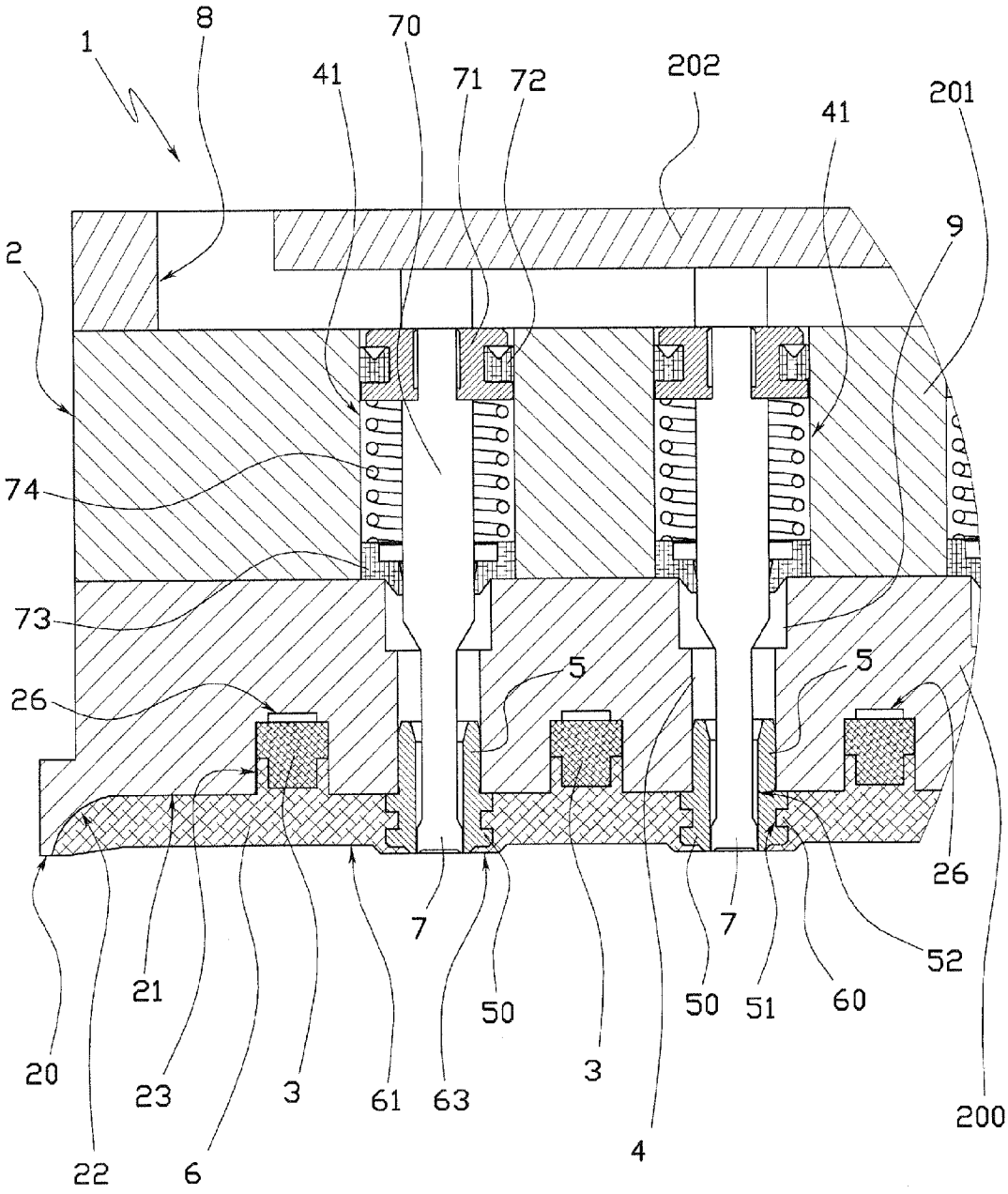
FIG. 4 is a detail of the section along line IV-IV of FIG. 1.

The die 1 comprises a metal body 2 with a rectangular plan shape, formed by three superposed plates which are fixed by screws, of which a front plate 200, an intermediate plate 201 and a back plate 202 (see FIG. 4).

The metal body 2 exhibits an active face 20 destined to face towards the lo forming cavity of the ceramic press to which the die 1 will be associated.

As shown in FIG. 4, a rectangular first concentric hollow 21 with a constant depth is afforded on the active face 20, which hollow 21 is connected to the external edge of the metal body 2 by means of a countersunk perimeter strip 22.

Figure 2:
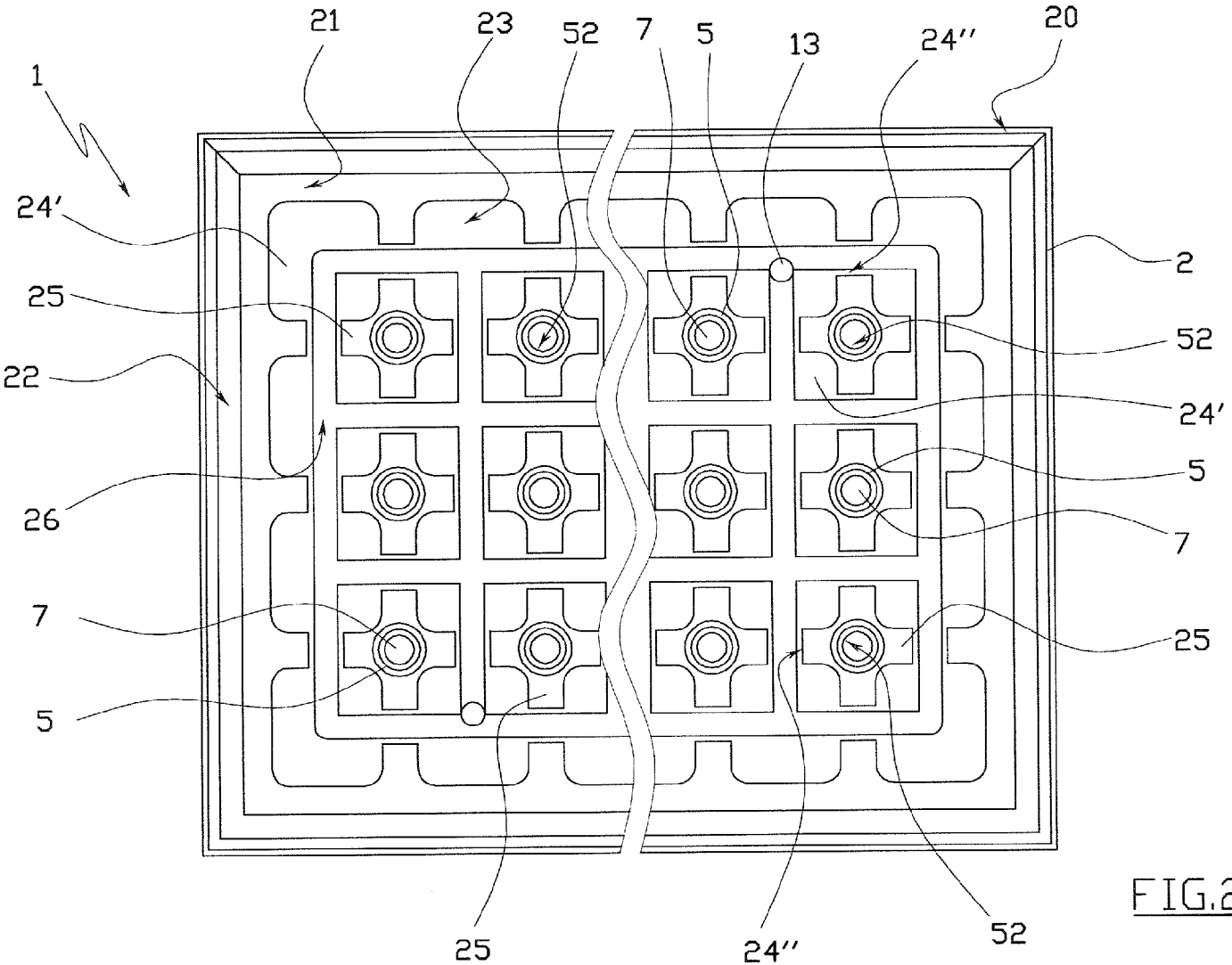
FIG. 2 is a plan view of the die of FIG. 1 without the elastic membrane.

A second concentric hollow 23 is afforded on the bottom of the first hollow 21, which second hollow 23 has a constant depth which in plan view generally exhibits a regular grid shape (see FIG. 2).

In particular, the grid 23 comprises a plurality of cells 24' which are uniformly distributed and which are reciprocally connected by means of straight channels 24".

In plan view the cells 24' are generally square with longer sides than the width of the straight channels 24".

In this way, a plurality of generally cross-shaped relief zones are defined between the cells 24', a top of which is at the same level as the bottom of the first hollow 21.

Finally, a third hollow 26 is afforded on the bottom of the second hollow 23, which third hollow 26 is formed by a grid having straight, reciprocally perpendicular channels.

The straight channels are narrower than the channels 24" of the second hollow 23, and develop along the channels 24" such as to groove and cross each single cell 24'.

A grid 3 made of an elastically deformable material, which is separately prepared, is positioned internally of the second hollow 23.

Figure 3:
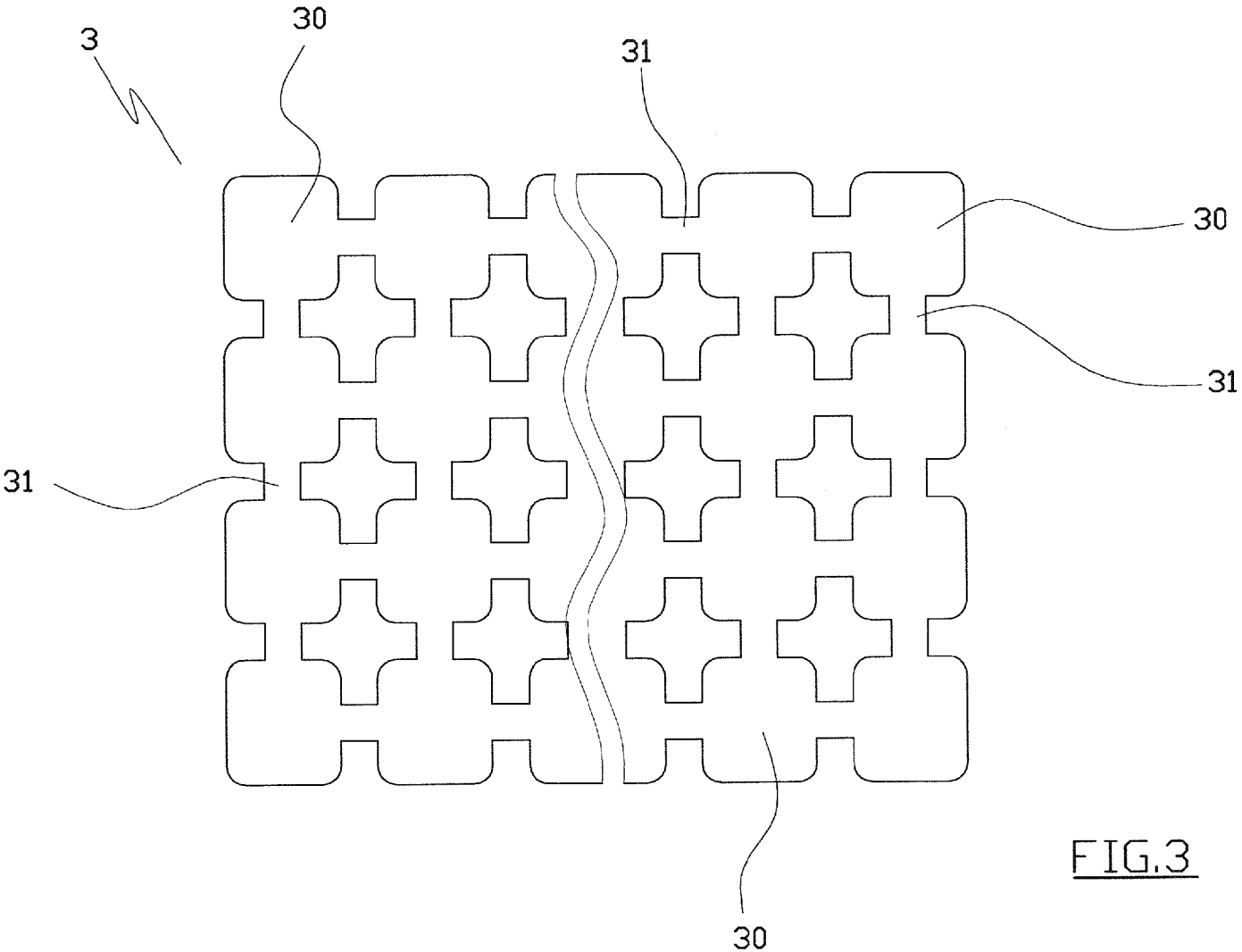
FIG. 3 is a plan view of the "anti-transparency" grid belonging to the die of FIG. 1.

As illustrated in FIG. 3, the grid 3 has a shape which is similar to the grid of the second hollow 23 of the metal body 2, such as to be received snugly internally thereof.

In particular, the grid 3 comprises a plurality of forms 30 which corresponding to the cells 24' and which are joined by straight tracts 31 which correspond to the channels 24".

The grid 3 has a constant thickness which is slightly less than the depth of the second hollow 23, and is preferably made of an elastomer material.

In transversal section, the grid 3 comprises a first layer which is inserted snugly internally of the second hollow 23 of the metal body 2 in contact with the bottom thereof, on which is laid a second layer having a same shape with a smaller width (see FIG. 4).

The face of the grid 3 in contact with the bottom of the second hollow 23 closes the channels of the third hollow 26, such as to define a free space which in plan view is a labyrinth grid.

A plurality of vertical holes 4 are afforded in the metal body 2, each of which vertical holes 4 centrally crosses a respective cross-zone 25 and opens onto the bottom of the first hollow 21.

A guide bushing 5 made of wear-resistant hard material is press-inserted, or inserted using other known fitting systems, internally of each vertical hole 4. The bushing is provided with a head 50 having a greater diameter which projects with respect to the bottom of the first hollow 21, and a top of which is generally in line with the upper edge of the metal body 2.

In particular, the projecting head 50 exhibits an undercut circumferential channel 51 along the lateral surface thereof.

The internal cavity 52 of each guide bushing 5 defines a breather mouth which sets the relative vertical hole 4 in communication with the outside.

Note that the rigid guide bushings 5 could alternatively be in a single piece together with the metal body 2, for example in the form of further salient appendages rising up from the cross zone 25.

As illustrated in FIG. 4, each vertical hole 4 is in communication with a system of horizontal discharge conduits 9 (denoted by a broken line in FIG. 1) which are afforded in the front plate 200 of the metal body 2 and which open out to the outside through the lateral walls thereof.

After the guide bushings 5 and the grid 3 have been coupled to the metal body 2, a layer of a mastic or of a suitable adhesive glue is applied on the metal body 2.

In particular, the layer of mastic is laid on the bottom of the first hollow 21, on the perimeter strip 22, on the portions of the lateral walls of the channels 24" and the cells 24' not covered by the grid 3, on the free faces of the grid 3 and on the lateral surface of the projecting heads 50 of the guide bushings 5.

Thus, internally of the first hollow 21 a fluid resin normally used in the sector is dropped, which, after hardening, realizes an elastically-deformable membrane 6.

In this way, the posterior face of the elastic membrane 6 exhibits a grid in relief which is sealedly coupled internally of the grid 23 of the metal body 2. Further, it also exhibits a series of through-holes, each of which receives the projecting head 50 of a respective guide bushing 5 and is provided with a circumferential rib 60 which couples to the undercut channel 51 and solidly anchors the guide bushing 5 to the membrane 6.

Figure 1:
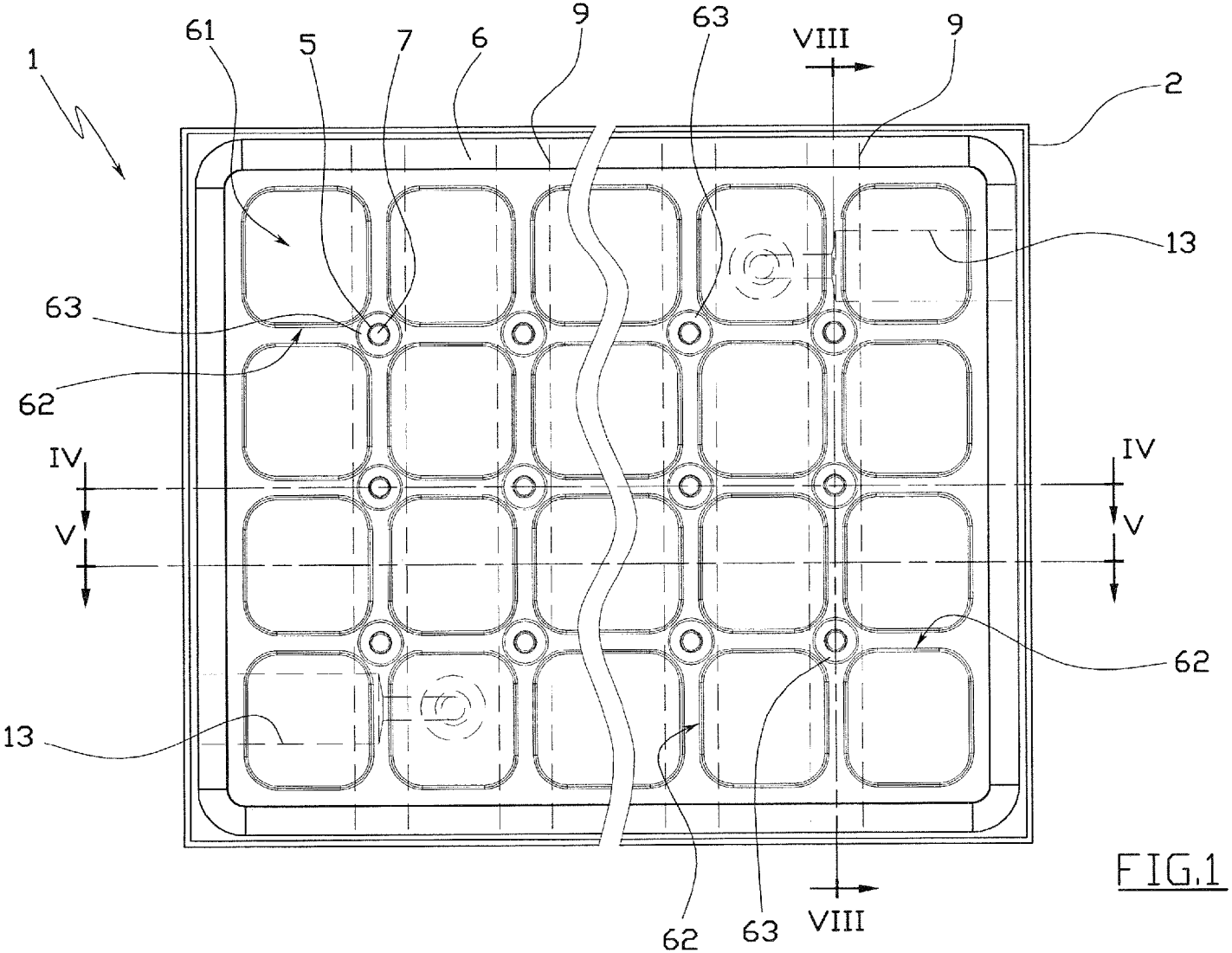
FIG. 1 is a plan view of an isostatic die of the invention.

During forming, a grid of identical crossed channels 62 is formed on the external active face 61 of the membrane 6, which crossed channels 62 are for shaping the feet of the tiles (see FIG. 1).

In particular, the crosspoints of the crossed channels 62 are vertically superposed on the cross-zones 25 of the metal body 2, and are identified by a series of prominences 63 having a generally circular plan shape.

A relative guide bushing 5 is located at the centre of each prominence 63, a top of which bushing 5 is in line with the top of the prominence 63.

Thanks to the mastic, the elastic membrane 6 is strongly gripped to all the parts of the metal body 2, the grid 3 and the guide bushings 5, on which the mastic has been previously applied.

Note that the grid 3 and the elastic membrane 6 are constituted by elastomer resins having generally different elastic characteristics. Preferably the resin of the elastic membrane 6 is more elastic and flexible than that of the grid 3 which is therefore more rigid.

A cylindrical valve body 7 is slidably housed in each guide bushing 5, which valve body 7 partially obstructs the breather mouth 52, leaving a small fissure communicating with the underlying vertical hole 4.

The small fissure is of an entity such as to enable passage of the air, while it effectively obstructs any leaking of the ceramic powder, which is compacted lo during the forming of the tiles.

The opening can be obtained by realising the cylindrical valve body 7 with a slightly smaller diameter with respect to the breather mouth 52 of the guide bushing 5, for example by specially calibrating the working tolerances.

For example, the diameter of the cylindrical valve body 7 can be made less by about 0.2 mm than the diameter of the breather mouth 52.

Each valve body 7 is borne at the end of a stem 70 which is slidable internally of the vertical hole 4, the posterior end of which is associated to respective means for activating which cause the posterior end to slide at each pressing cycle.

The means for activating comprise a brass plate 71 fixed to the posterior end of the stem 70 and slidably received internally of a cylindrical seating 41 which is afforded in the intermediate plate 201 of the metal body 2, posteriorly with respect to the discharge conduit 9.

In particular, the cylindrical seating 41 is arranged coaxially of the hole 4 and has a greater diameter with respect to the width of the discharge conduit 9.

A seal ring 72 is placed between the plate 71 and the lateral wall of the cylindrical seating 41, while a dust ring 73 is located between the lateral wall of the cylindrical seating 41 and the stem 70, which dust ring 73 rests on the edges of the discharge conduit 9.

A compression spring 74 is interposed between the dust ring 73 and the plate 71, which spring 74 maintains the valve body 7 in the rest position illustrated in FIG. 4.

In this position the valve body 7 is in line with the top of the guide bushing 5 and thus also with the prominence 63 of the elastic membrane 6, while the plate 71 is at the posterior endrun position.

As illustrated in FIG. 4, each cylindrical seating 41 opens internally of a back-lying conduit 8, which conduit 8 is afforded in the posterior plate 202 of the metal body 2, and is destined to convey a pressurized operating fluid, generally compressed air, which is supplied by a usual dispenser device (not shown).

The operating fluid acts on the face of the plate 71 opposite the compression spring 74, such as to push the stem 70 and cause the valve body to extend completely with respect to the active face 61 of the elastic membrane 6.

In this embodiment, the conduit 8 places all the cylindrical seatings 41 of the die 1 in reciprocal communication, such that the activating of the valve bodies 7 occurs contemporaneously; however it is possible to connect the cylindrical seatings 41 via independent conduits in order to activate different valve bodies 7 on different areas of the die 1 according to need.

Figure 6:
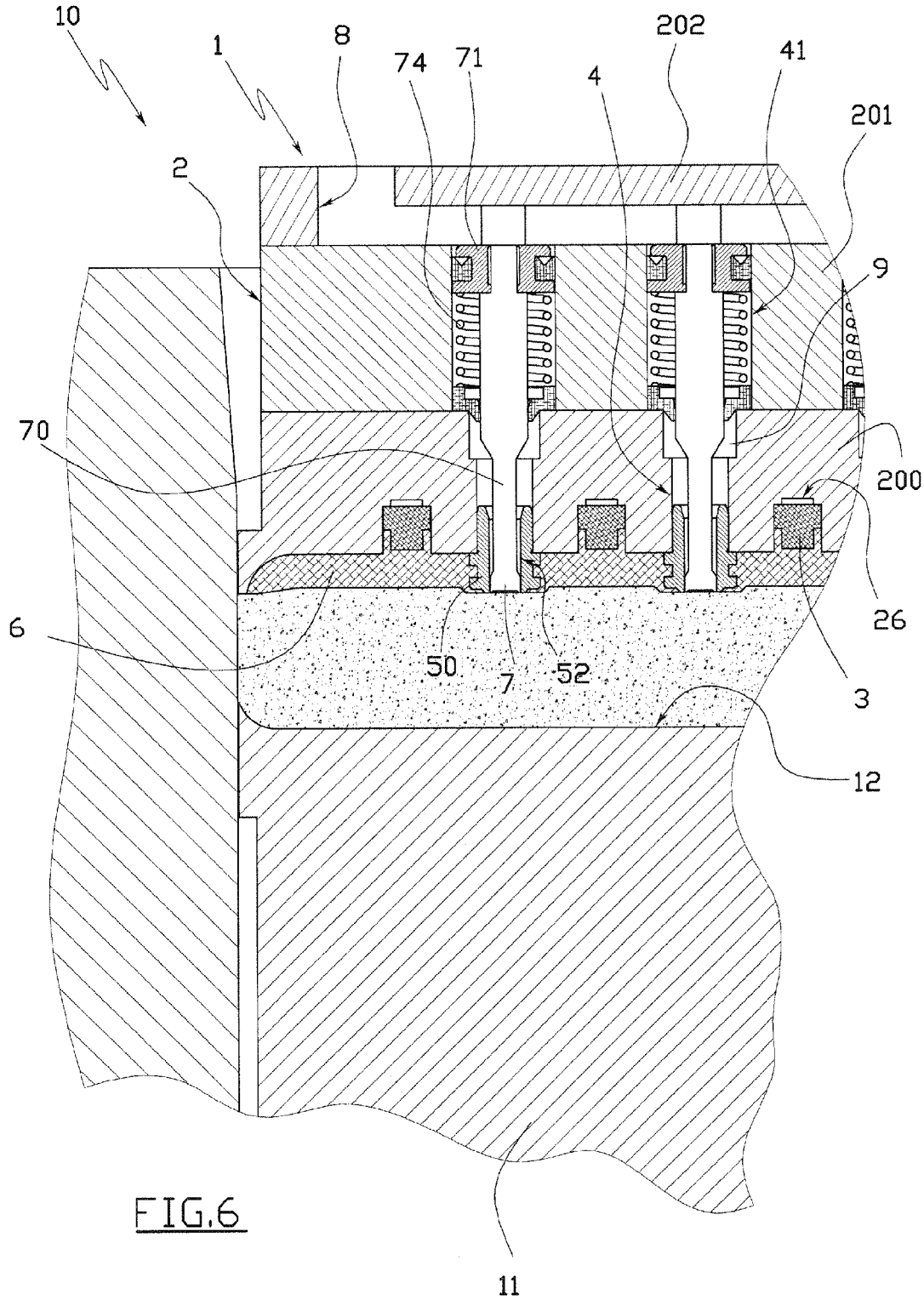
FIG. 6 is a detail of a ceramic press provided with the die of FIG. 1 during a compacting stage of the ceramic powders.
Figure 7:
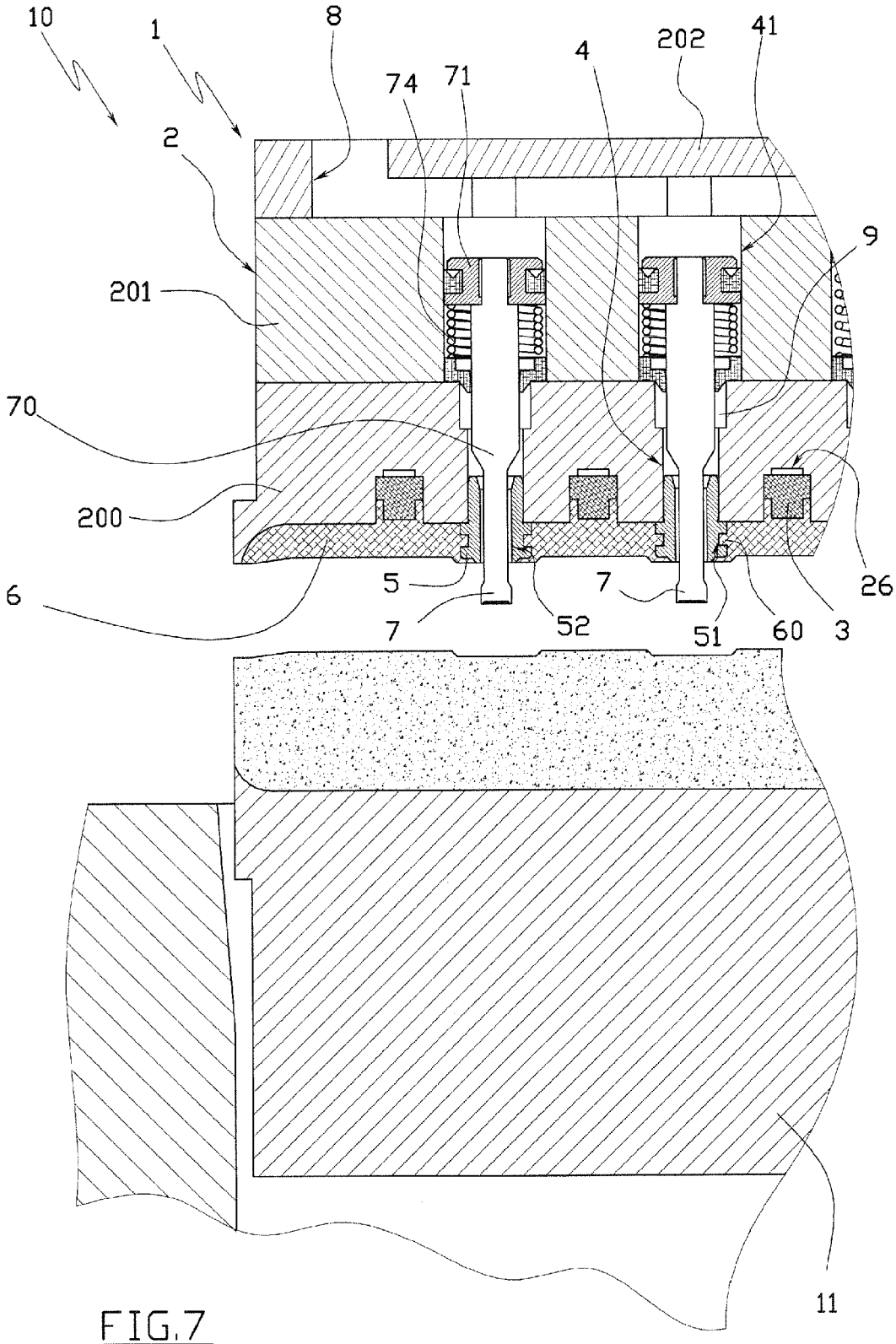
FIG. 7 is the detail of FIG. 6 during a following stage of discharge of the compacted tile.

In the illustrated embodiment of FIGS. 6 and 7, the die 1 is associated to a entering punch-type die 10 for forming ceramic tiles.

In particular, the die 1 is destined to form a laying face of the tiles and is located superiorly of a die 11 of a traditional type, which is destined to form the in-view face of the tile.

Obviously the invention is well suited to other types of press, for example a mobile matrix press. Further, the arrangement of the dies 1, 11 can be different from what is illustrated, as can their shape and function. In particular, with slight modifications the die 1 could be used for forming the in-view face of the tiles.

Before installing the dies in the press 10, the free space formed by the channels 26 covered by the grid 3 is filled with an incompressible fluid, generally pressurized hydraulic oil, and is then sealedly closed.

The introduction of oil is done by special conduits such as those indicated with a broken line and denoted by 13 in FIG. 1.

Figure 5:
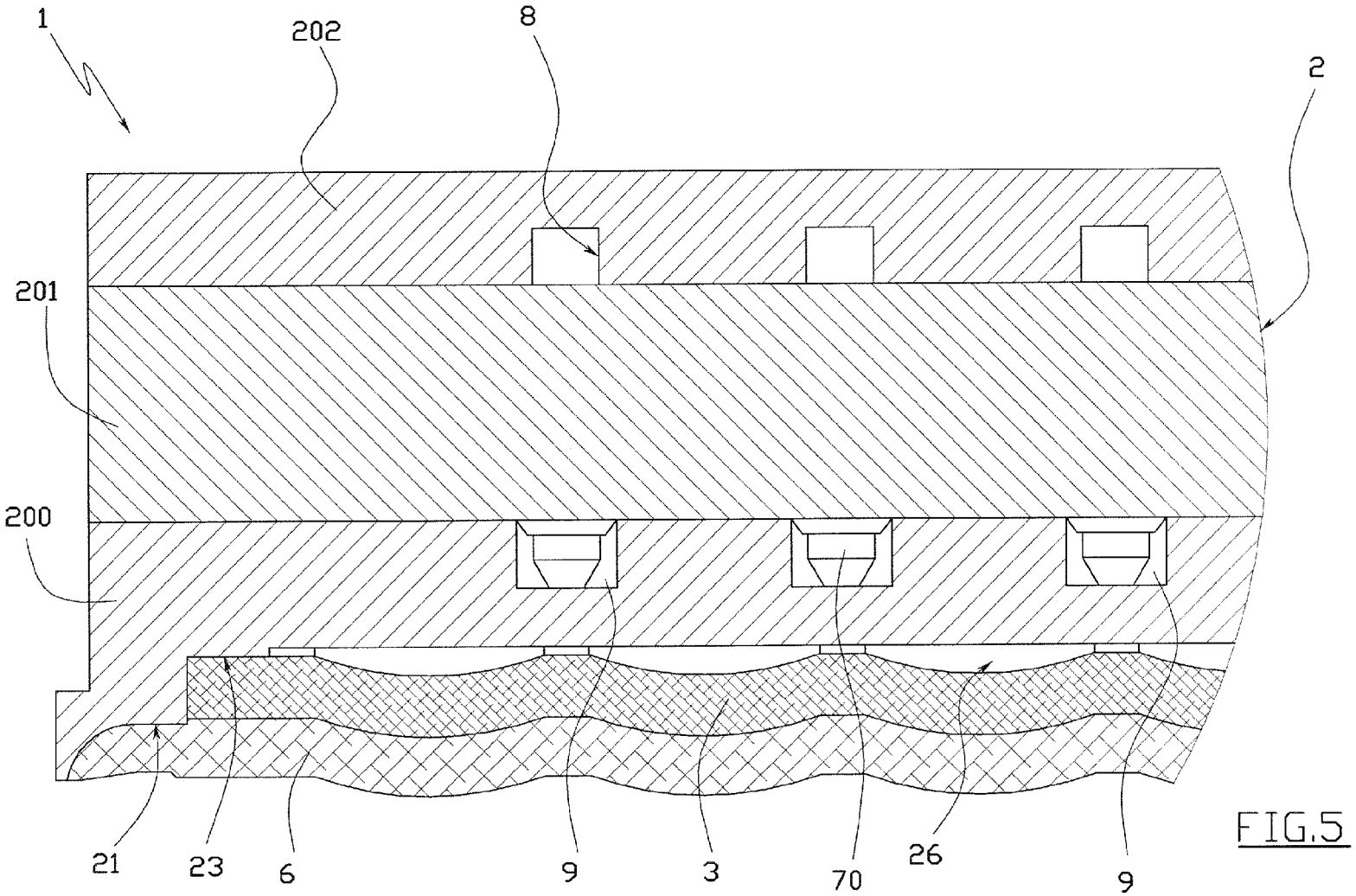
FIG. 5 is a detail of the section along line V-V denoted in FIG. 1, shown after injection of the incompressible pressurized fluid.

The introduction of the pressurized oil leads to corresponding elastic deformations of the grid 3 and the elastic membrane 6 (see FIG. 5). In particular, at the cells 24' and the channels 24" (see FIG. 2), the grid 3 is distanced from the bottom and arches, causing the elastic membrane 6 to rise too.

The membrane 6 is however gripped to the perimeter strip 22 of the metal body 2, at the top of the cross zones 25 and at all the other zones on which the glue has been applied. Therefore it substantially tends to arch only at the position of the cells 24', assuming a generally lumpy surface appearance. In this way, the die 1 functions as an isostatic die which enables a uniform density of the ceramic material of the compacted tile to be achieved.

At the same time, the presence of the grid 3 enables the well-known phenomenon of "transparency", in which underlying structures of the rest base of the tile are apparent from the tile in-view surface, to be prevented from occurring.

During this stage, the operating fluid circulating in the conduit 8 is discharged, so that the compression springs 74 maintain the valve bodies 7 in the rest position, with the tops thereof coplanar to the active face 61 of the elastic membrane 6.

Figure 8:
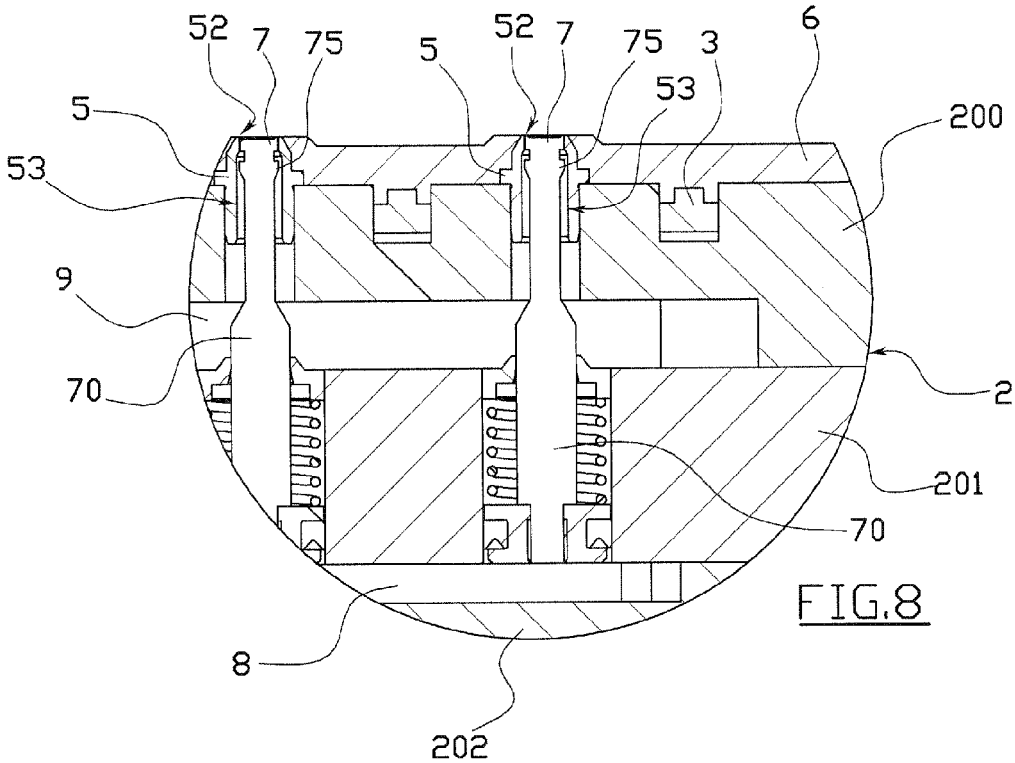
FIGS. 8 and 9 illustrate a variant of the die of FIG. 1, shown along lines VIII-VIII of FIG. 1, respectively during the stage of compacting the ceramic powders and during the following discharge stage thereof.

The air imprisoned in the forming cavity 12 can therefore exit freely through the slim fissures defined between the valve bodies 7 and the breather mouths 52 of the relative guide bushings 5; then the air flows through the vertical holes 4, and from there reaches the outside environment, crossing the horizontal discharge conduits 9 (see FIG. 8).

In this way, a singly-directed air current from the centre to the periphery of the forming cavity 12 is not established and an undesirable re-distribution of the ceramic powders contained in the forming cavity 12 is prevented. Notwithstanding the small size of the fissures, the air may draw some particles of ceramic material with it.

This however does not create drawbacks, since the particles are also expelled towards the outside; further, the abrasive action they tend to produce is mostly concentrated at the edges of the guide bushings 5, which are difficult to damage as they are made of materials that are particularly resistant to abrasion.

When the compacting is finished, as soon as the formed tile is removed and distanced, pressurized fluid is sent into the conduit 8 so as to make the plates 71 slide in the direction which causes the relative compression springs 74 to compress in the direction of the dust ring 73.

In this way, the valve bodies 7 are made to exit from the respective guide bushings 5, increasing the passage hole of the breather mouth 52 in order to allow removal and distancing of the ceramic material particles which might be blocked between the valve bodies 7 and the internal wall of the respective guide bushings 5 (see FIG. 7).

Then the pressurized operating fluid present in the conduit 8 is immediately discharged so that the valve bodies 7 can return to the normal position, pushed by the compression springs 74, for a new compacting cycle.

Note that the above-mentioned compression springs 74 can be replaced by an auxiliary hydraulic circuit, which supplies a pressurized fluid to the cylindrical seatings 41, which fluid acts on the plates 71 on the opposite side with respect to the fluid coming from the conduit 8.

In this case, during the extraction of the valve bodies 7, the auxiliary circuit is kept charged up, and is activated to return the valve bodies 7 to the initial position.

Figure 9:
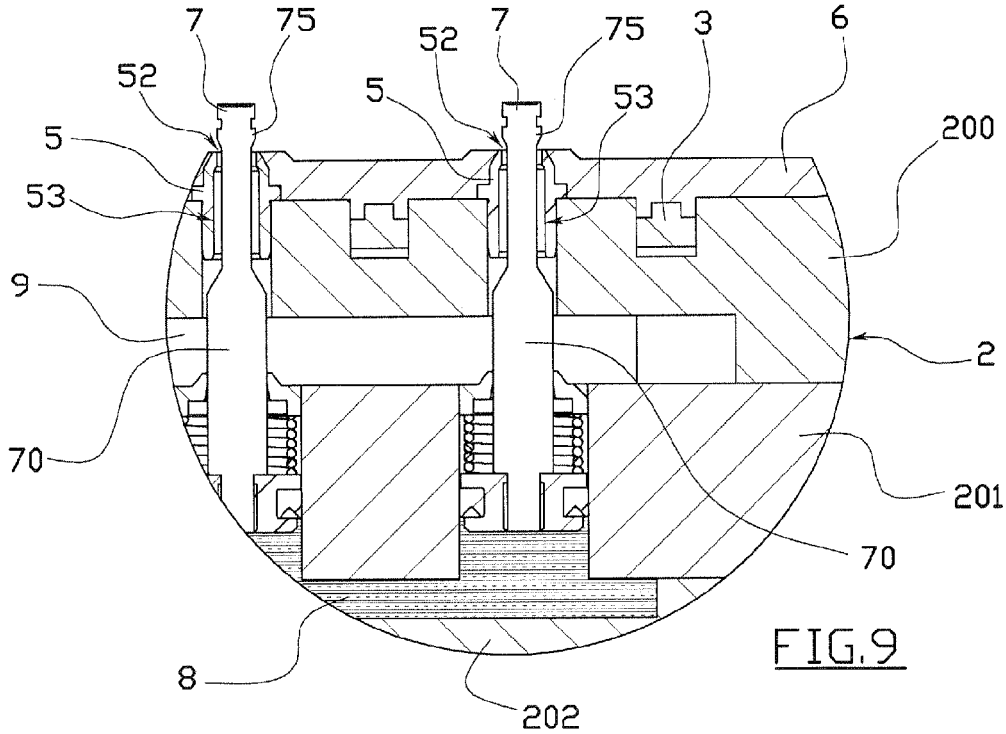

FIGS. 8 and 9 illustrate a variant of the invention, which consists in improving the removal of the particles of ceramic material trapped between the valve bodies 7 and the relative guide bushings 5.

In this variant, the internal cavity of each guide bushing 5 exhibits a tract 53 having an increased diameter located behind the mouth defining the breather mouth 52.

Further, each stem 70 is provided with a scraper body 75 which is substantially cylindrical and annular and which is positioned coaxially behind the valve body 7, and is distanced therefrom by a circumferential channel.

The scraper body 75 has a slightly bigger diameter than the valve body 7 but is in any case destined to pass internally of the breather mouth 52 defined by the mouth of the guide bushing 5.

For example, the diameter of the scraper body can be about 0.12mm less than the diameter of the breather mouth 52.

When the valve body 7 is in the rest position, in which it occupies the breather mouth 52, the scraper body 75 is contained internally of the enlarged tract 53 of the guide bushing 5, such as to enable passage of air coming from the forming cavity.

When the stem 70 slides in the direction to cause the valve body 7 to exit from the guide bushing 5, the scraper body 75 passes internally of the breather mouth 52 and, by mechanical action, draws along with it the particles of ceramic material which might be imprisoned and discharges them to the outside.

Figure 10:
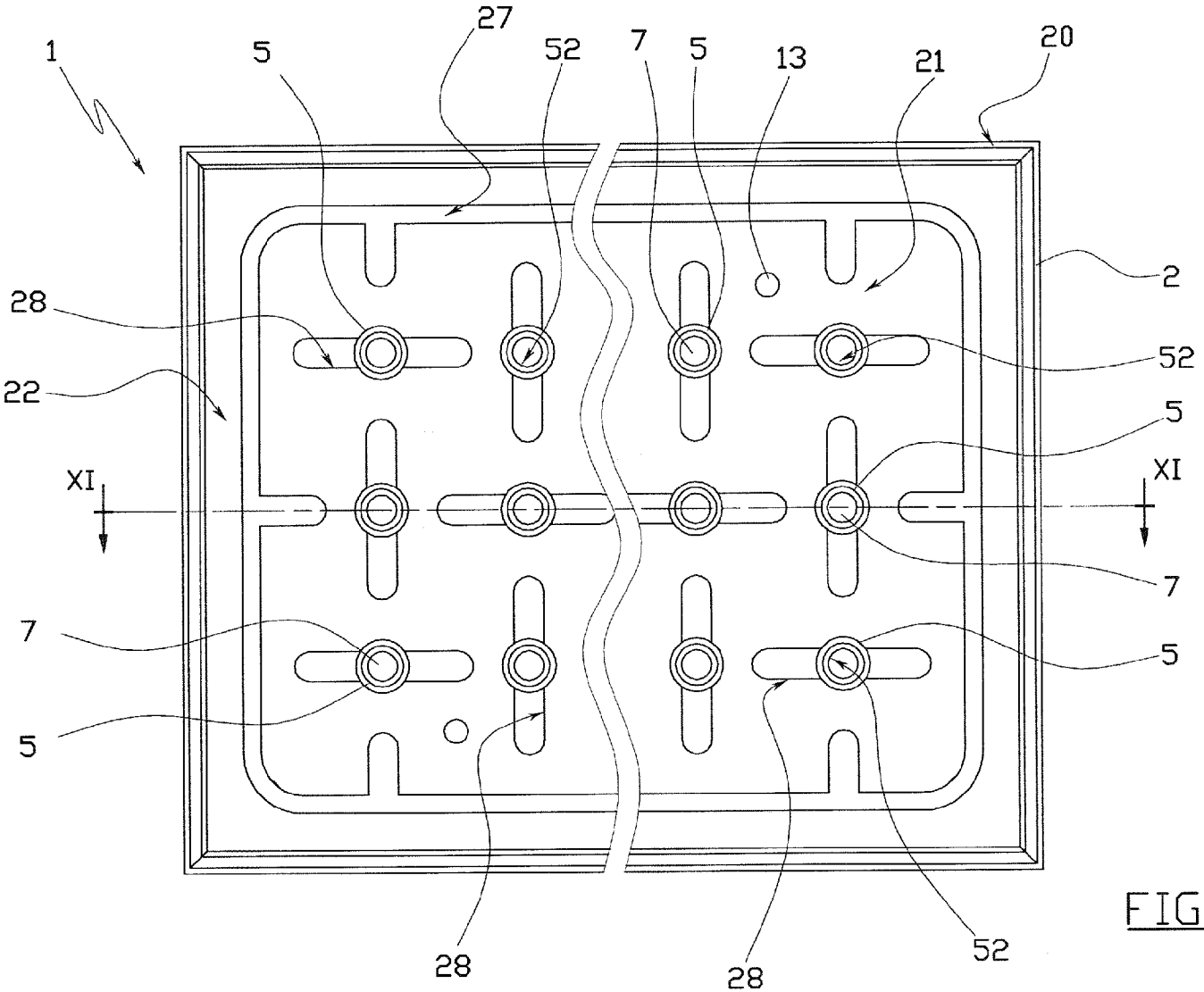
FIG. 10 is a plan view of an isostatic die in a first alternative embodiment of the invention, and without the elastic membrane.
Figure 11:
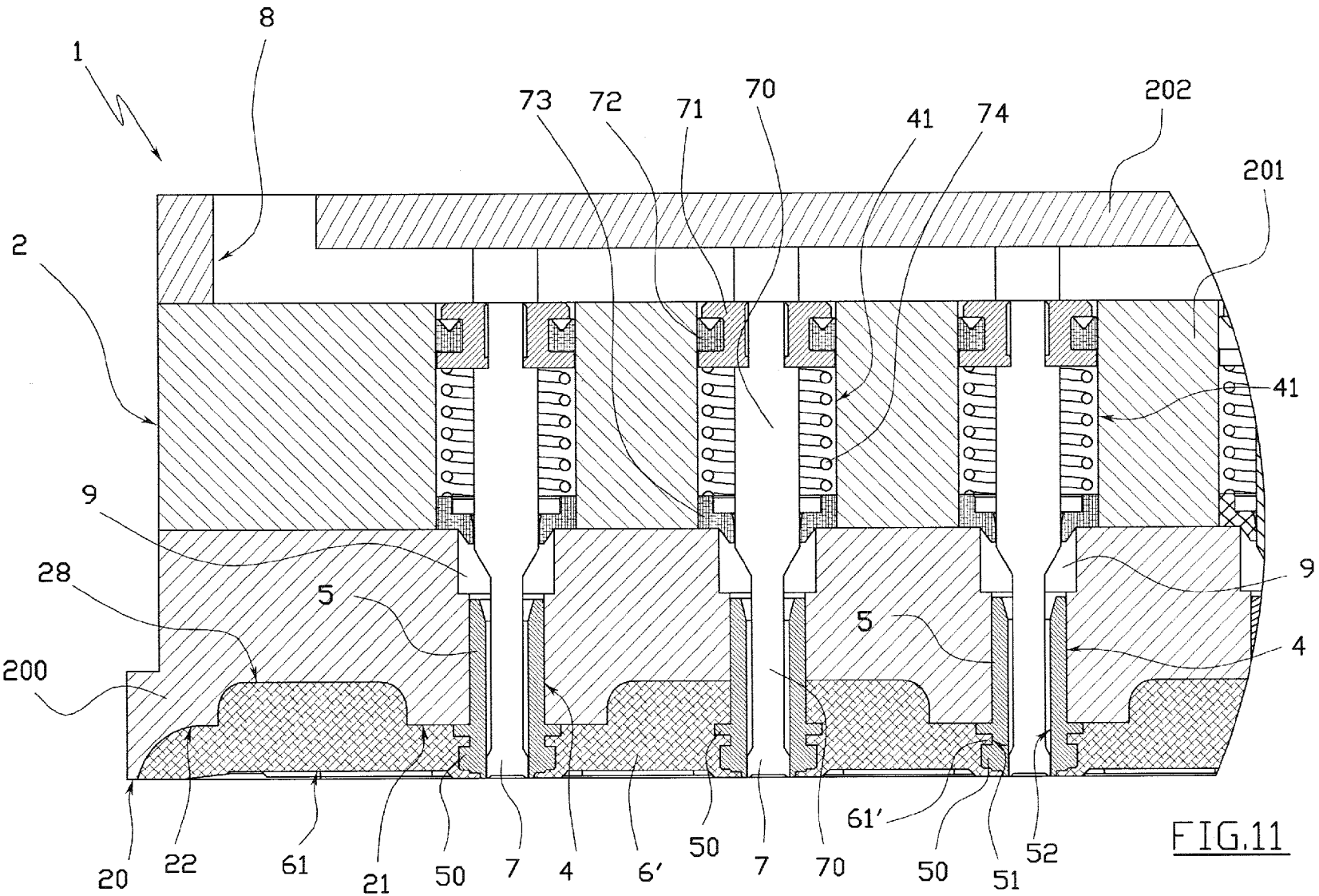
FIG. 11 is a detail of section XI-XI denoted in FIG. 10, where the elastic membrane is present.

In FIGS. 10 and 11, a first alternative embodiment of the invention is illustrated, which differs from the previous embodiment due to the fact that the die 1 does not exhibit the anti-transparency grid 3.

In this case, the first hollow 21 is circumscribed by a channel 27 which runs along the edges of the metal body 2 and separates it from the perimeter strip 22.

The bottom of the first hollow 21 is grooved by a plurality of shaped cavities 28, which are separate from one another and do not reciprocally communicate.

The cavities 28 are all of the same depths and are generally rectangular in plan view with rounded ends.

A respective vertical hole 4 opens on the bottom of each cavity 28, which vertical hole 4 is generally located in the median point of the cavity 28. The grooved cavities 28 are, in general but not necessarily, arranged aligned along rows which are parallel to the lateral edges of the metal body 2, and along each of the rows they are orientated such as to be alternatively perpendicular to one another.

The width of each cavity 28 is smaller than the diameter of the projecting head 50 of the guide bushing 5 housed in the respective vertical hole 4, so that the projecting head 50 rests directly on the bottom of the first hollow 21. A layer of mastic or glue is spread on the perimeter strip 22 of the metal body 2, internally of the channel 27, internally of the grooved cavities 28 and on the projecting head 50 of the guide bushings 5.

Then, internally of the first hollow 21, the fluid resin realising the elastically deformable membrane 6' is dropped.

In this way, the posterior face of the membrane 6' exhibits a series of protuberances in relief which are sealedly coupled and solidly gripped each to the inside of a respective grooved cavity 28.

Further, a through-hole forms at the centre of each protuberance which houses the projecting head 50 of the guide bushing 5 and which is provided with a rib 60' for coupling to the undercut channel 51, solidly anchoring the guide bushing 5 to the elastic membrane 6'.

Figure 12:
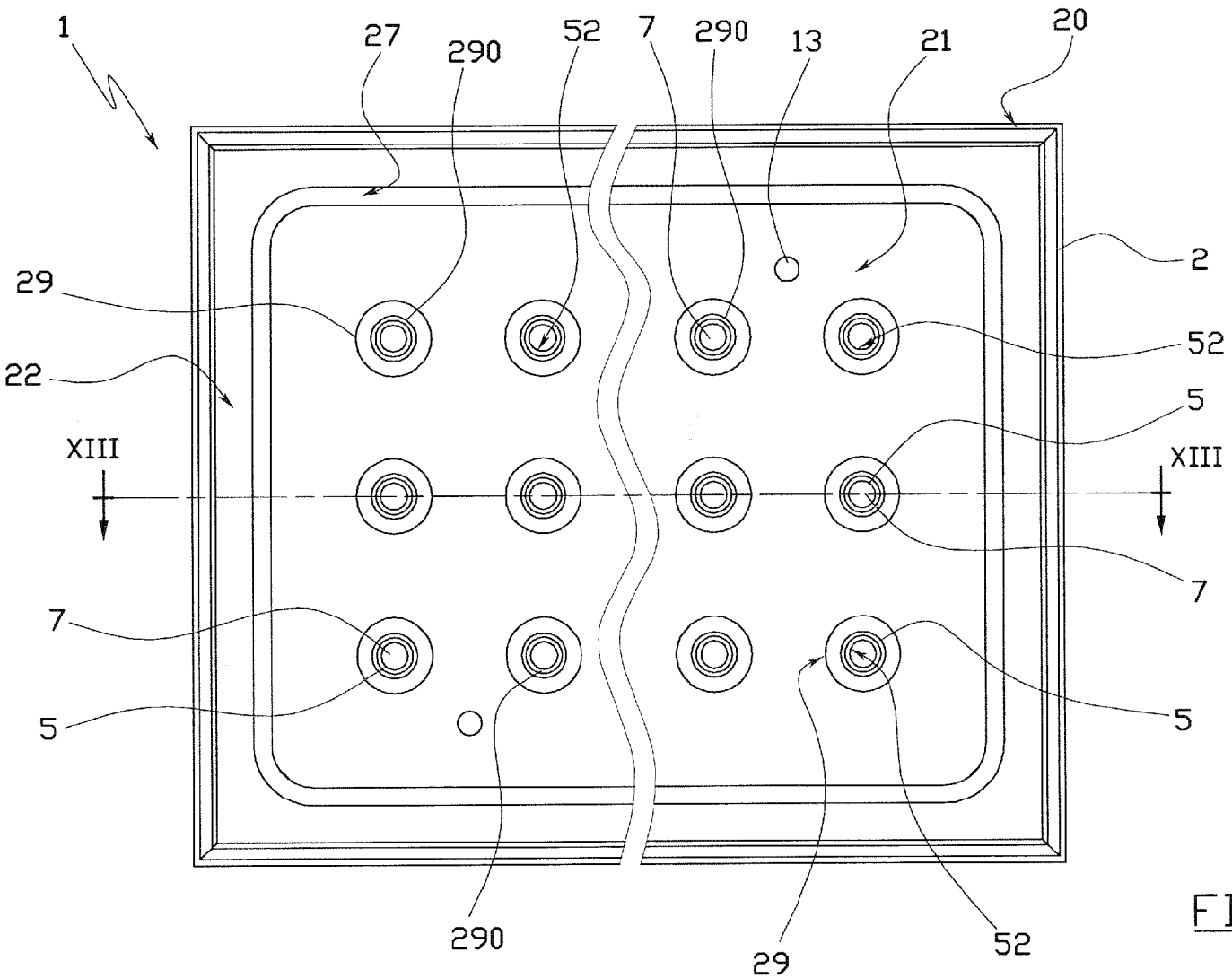
FIG. 12 is a plan view of an isostatic die according to a second alternative embodiment of the invention, and without the elastic membrane.
Figure 13:
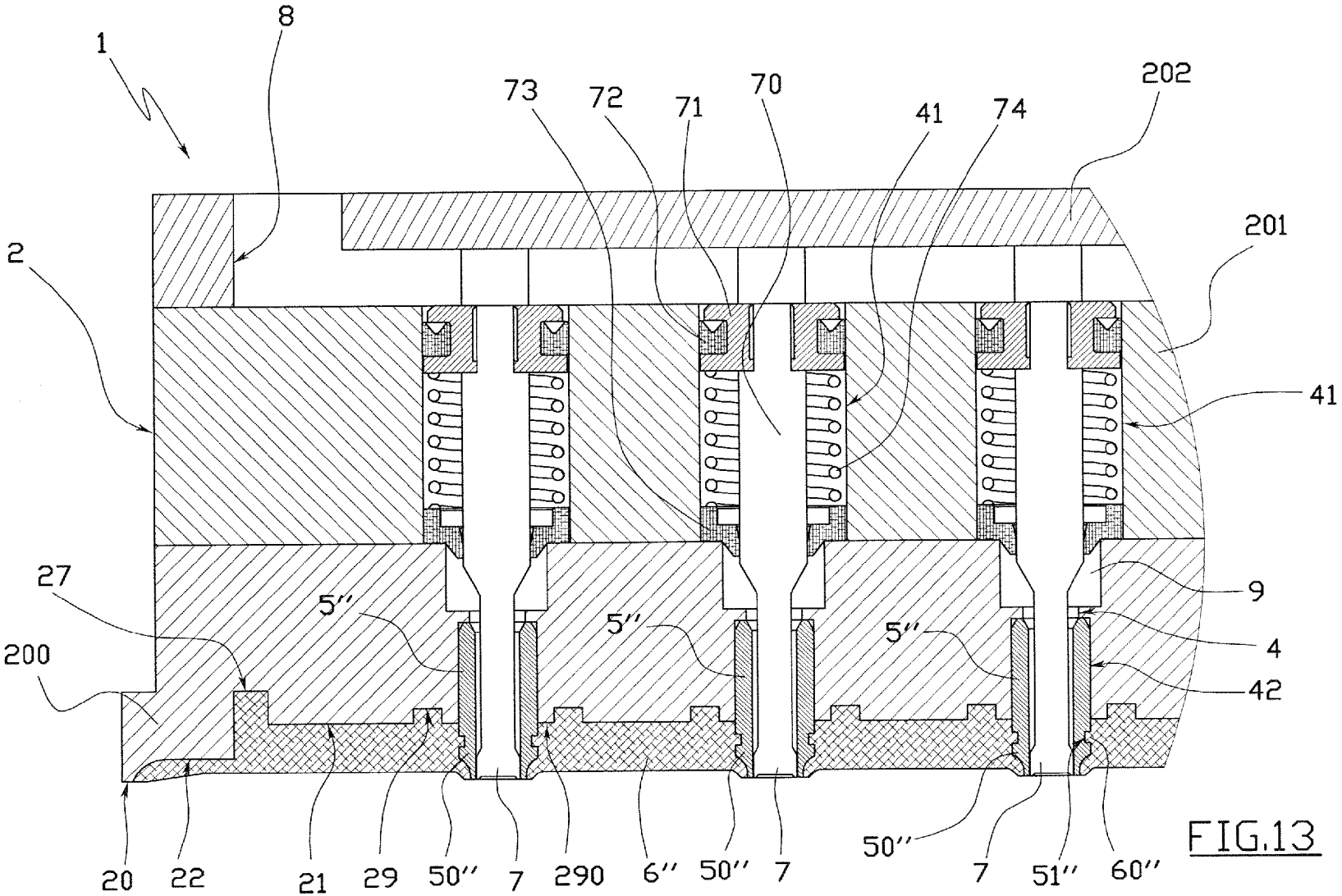
FIG. 13 is a detail of section XIII-XIII denoted in FIG. 12, where the elastic membrane is also present.

Apart from the above, the die 1 of the present embodiment is the same as the die of the previously-described embodiment, and has the same function. FIGS. 12 and 13 illustrate a second alternative embodiment of the invention, in which the die 1 is once more without the anti-transparency grid 3.

In this case too, the first hollow 21 is circumscribed by a channel 27 which runs along the edges of the metal body 2 and separates it from the perimeter strip 22.

A series of annular channels 29 are afforded on the bottom of the first hollow 21, each of which circumscribes a circular zone 290 at a centre of which a respective vertical hole 4 opens out.

A guide bushing 5" is inerted internally of each vertical hole 4, slightly different from the guide bushings described herein above (see FIG. 13).

In particular, the guide bushing 5" has a generally constant diameter and is inserted in an enlarged tract 42 of the vertical hole 4, where the posterior end thereof rests on an intermediate shoulder.

The shoulder is positioned at a distance from the bottom of the first hollow 21 which is such that the guide bushing 5" projects externally with a projecting tract 50" exhibiting an undercut circumferential channel 51".

A layer of mastic or glue is spread on the perimeter strip 22 of the metal body 2, internally of he channel 27 and the annular channels 29, on the top of all the circular zones 290 and on the projecting tract 450" of the guide bushings 5".

A fluid resin is then dropped, so as to realize an elastic membrane 6" the posterior face of which exhibits a series of annular ribs in relief which couple sealingly and are each tightly gripped internally of a respective annular channel 29.

Further, the elastic membrane 6" is strongly gripped also by the circular zones 290, where it forms a through-hole and a rib 60" which couple with the projecting tract 50" and respectively with the circumferential channel 51" of the guide bushings 5".

Apart from these particulars, the die 1 of the second alternative embodiment is the same as the previous die 1 and has the same type of functioning.

In figures from 14 to 18, a third alternative embodiment of the invention is illustrated, in which the isostatic die 1 is associated to an aspirating device (not shown) by means of as aspirating conduit 14.

The aspirating conduit 14 is in communication with the series of discharge conduits 9 afforded in the front plate 200 of the metal body 2, and which communicate with the breather mouths 52.

Figure 17:
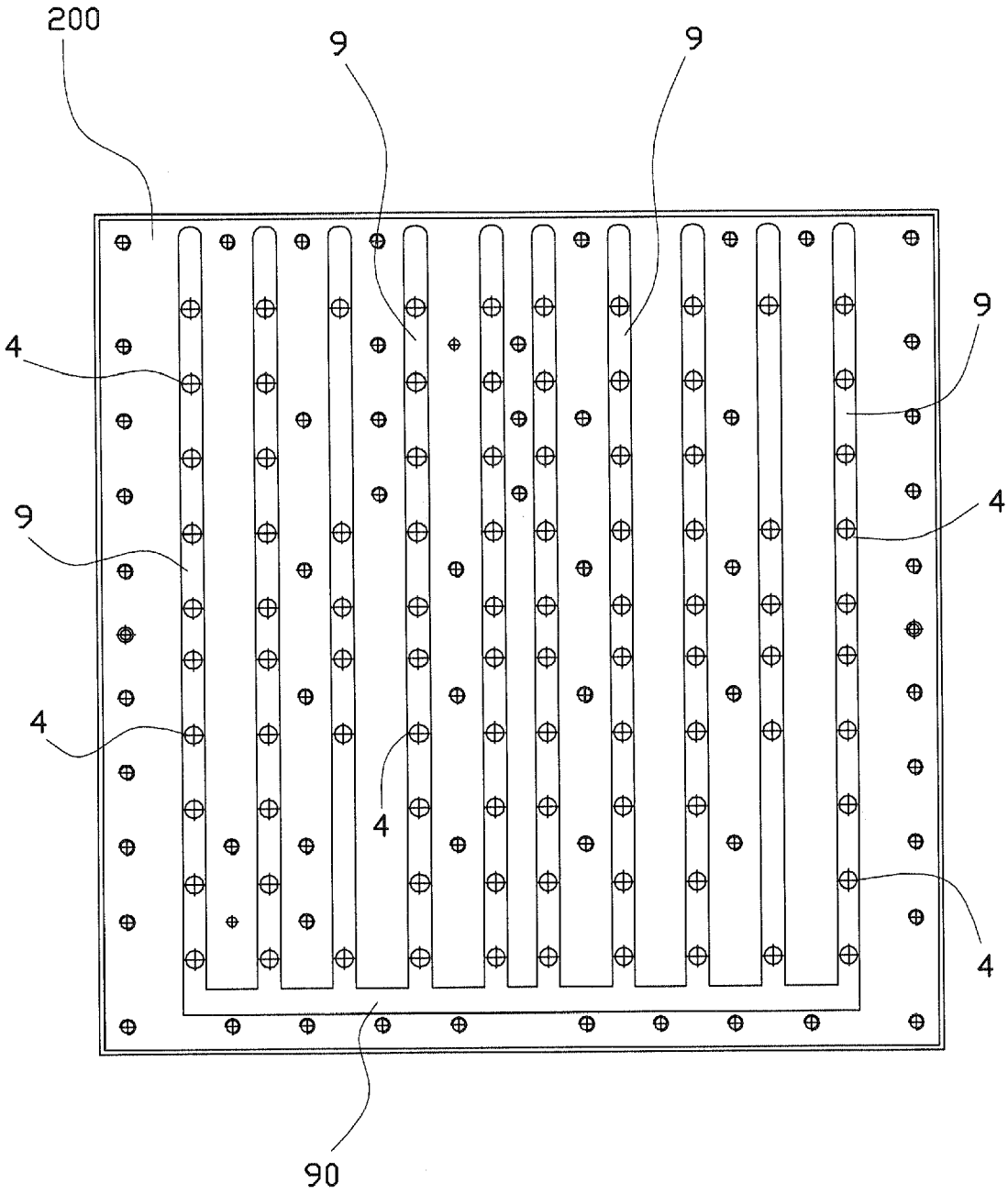
FIGS. 17 and 18 are respectively sections XVII-XVII and XVIII-XVIII of FIG. 16.

In particular, as illustrated in FIG. 17, the discharge conduits 9 are parallel to one another, and each of them is in communication with a whole row of vertical holes 4.

A first end of each discharge conduit 9 opens internally of a transversal channel 90, also afforded in the front plate 200 of the metal body 2, which makes the discharge conduits 9 reciprocally communicating.

Figure 16:
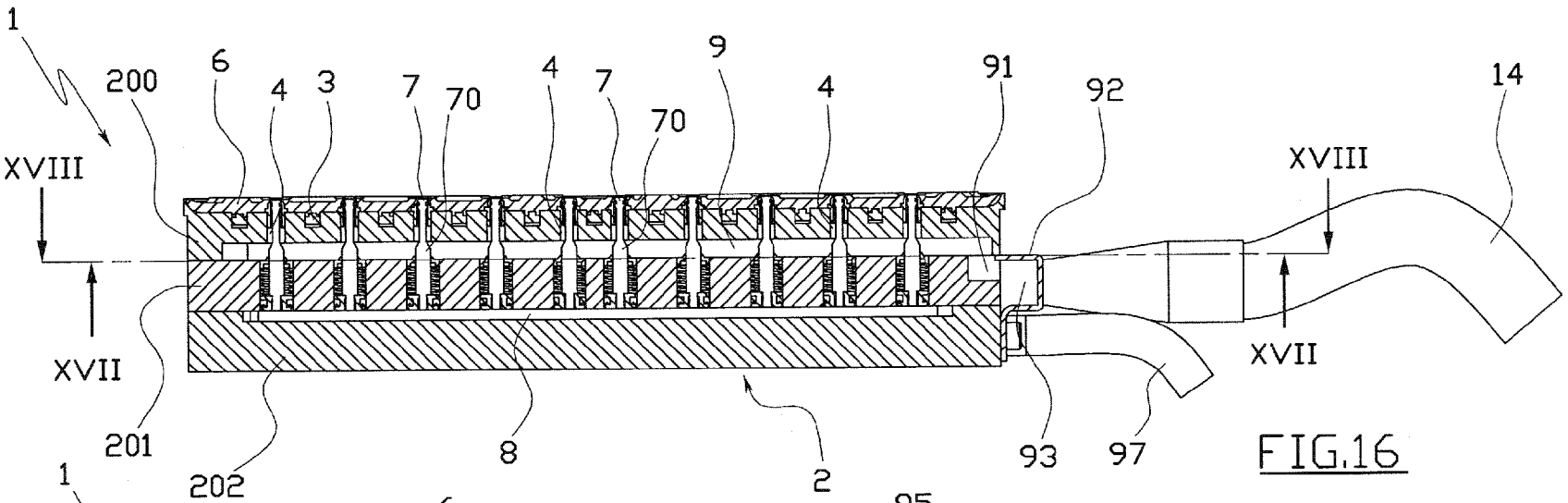
FIG. 16 is a section along line XVI-XVI of FIG. 15.
Figure 18:
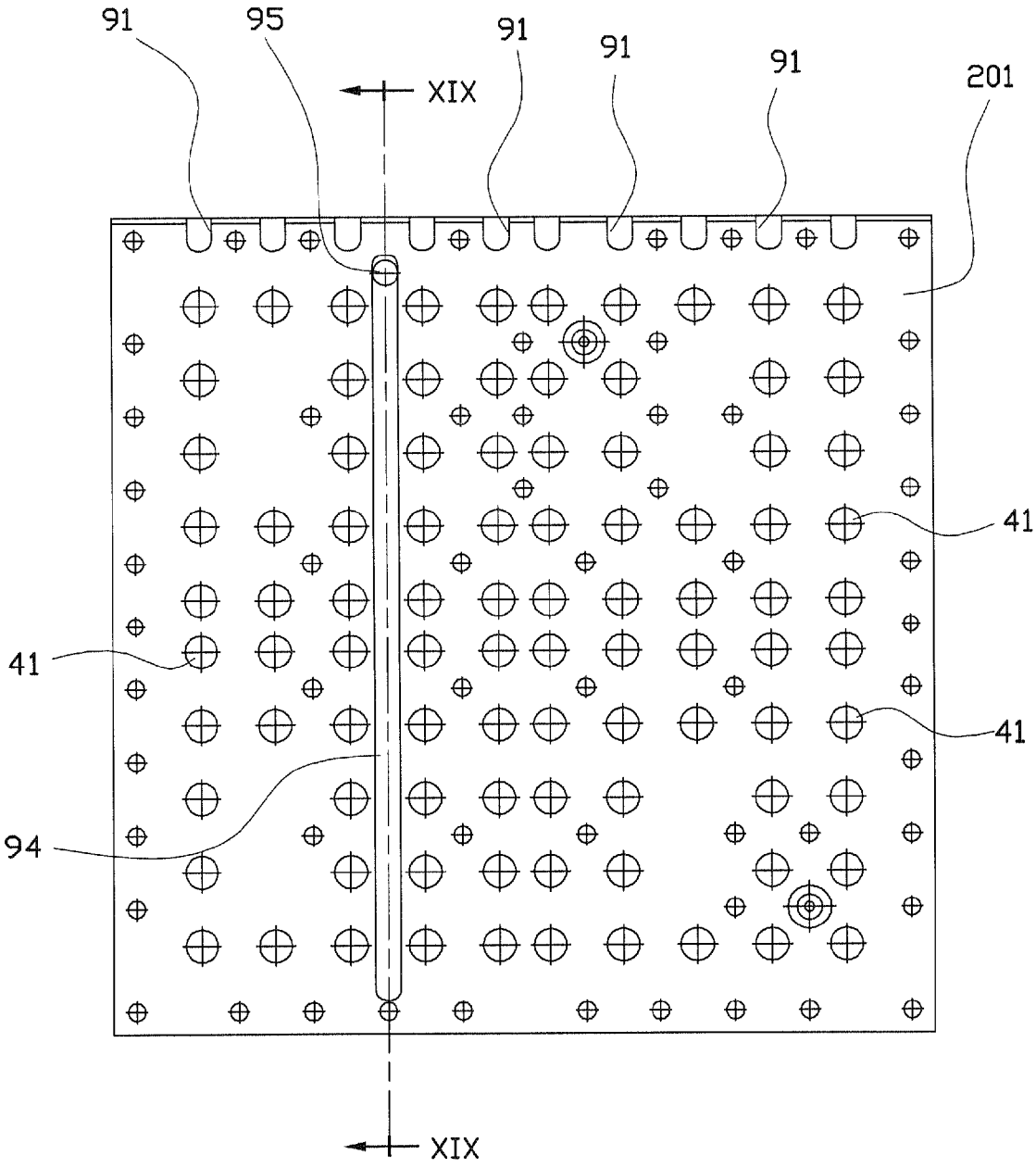

The second ends of the discharge conduits 9 are all in communication with a respective underlying opening 91, which is afforded in the intermediate plate 201 of the metal body 2, and opens onto an external flank thereof (see FIGS. 16 and 18).

A casing 92 is fixed to the external flank, which casing 92 defines a single aspirating manifold 93, which is hermetically closed and internally of which all the openings 91 terminate.

The aspirating manifold 93 communicates directly with the aspirating conduit 14.

As illustrated in FIG. 18, an auxiliary channel 94 is afforded in the intermediate plate 201 of the metal body 2.

The auxiliary channel 94 is parallel to the discharge conduits 9 and is located in an intermediate position between two thereof, in order to be closed by the front plate 200.

Figure 19:
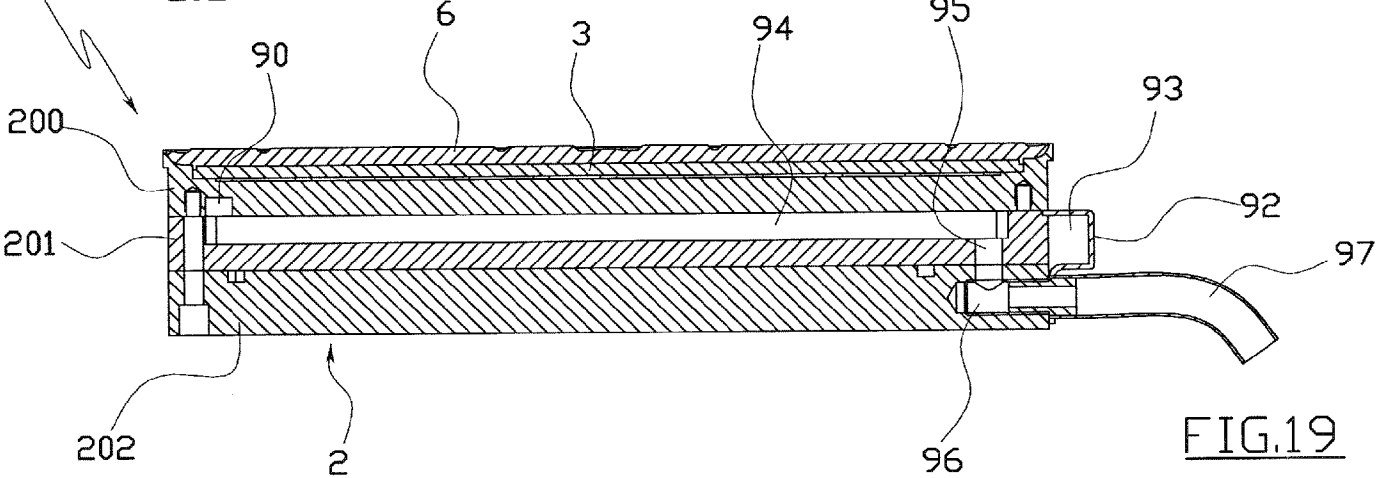
FIG. 19 is section XIX-XIX of FIG. 18.

The end of the auxiliary channel 14 located on the side of the opening 91 communicates with a vertical hole 95 opening into an elbow conduit 96 afforded in the posterior plate 202 of the metal body 2 (see also FIG. 19).

The elbow conduit 96 terminates externally of the metal body 2, where it is connected to an entry conduit 97, which is connected to a usual compressed-air blower device (not illustrated).

The end of the auxiliary channel 14 which is opposite the vertical hole 95 is in communication with the connection channel 90 of the discharge conduits 90 such that the discharge conduits 90 are reached by the compressed air injected by the blower device.

The blower device is usually inactive during the pressing stage, and the air contained in the forming cavity can freely flow into the discharge conduits 9 and exit to the outside through the manifold 93 and the aspiration conduit 14. During these stages, the aspirating device might be kept on, so as to facilitate the degassing of the forming cavity; however this must be when the aspirating action does not cause an excessive entraining of ceramic particles, which can be the situation when the degassing causes clogging problems in the fissures between the breather mouth 52 and the valve body 7.

It can occur that after a high number of pressing cycles, large quantities of ceramic powder material leaked from the breather mouths 52 accumulate in the discharge conduits 9.

To clean the discharge conduits 9, each time the die 1 completes a predetermined number of pressing cycles, the aspirating device and the blower device are contemporaneously activated.

In this way, the compressed air passes into the auxiliary channel 94 and, through the transversal channel 90, runs along the discharge conduits 9, pushing the ceramic powder towards the opening 91, where it is sucked into the aspirating manifold 93 by the aspirating device.

Figure 14:
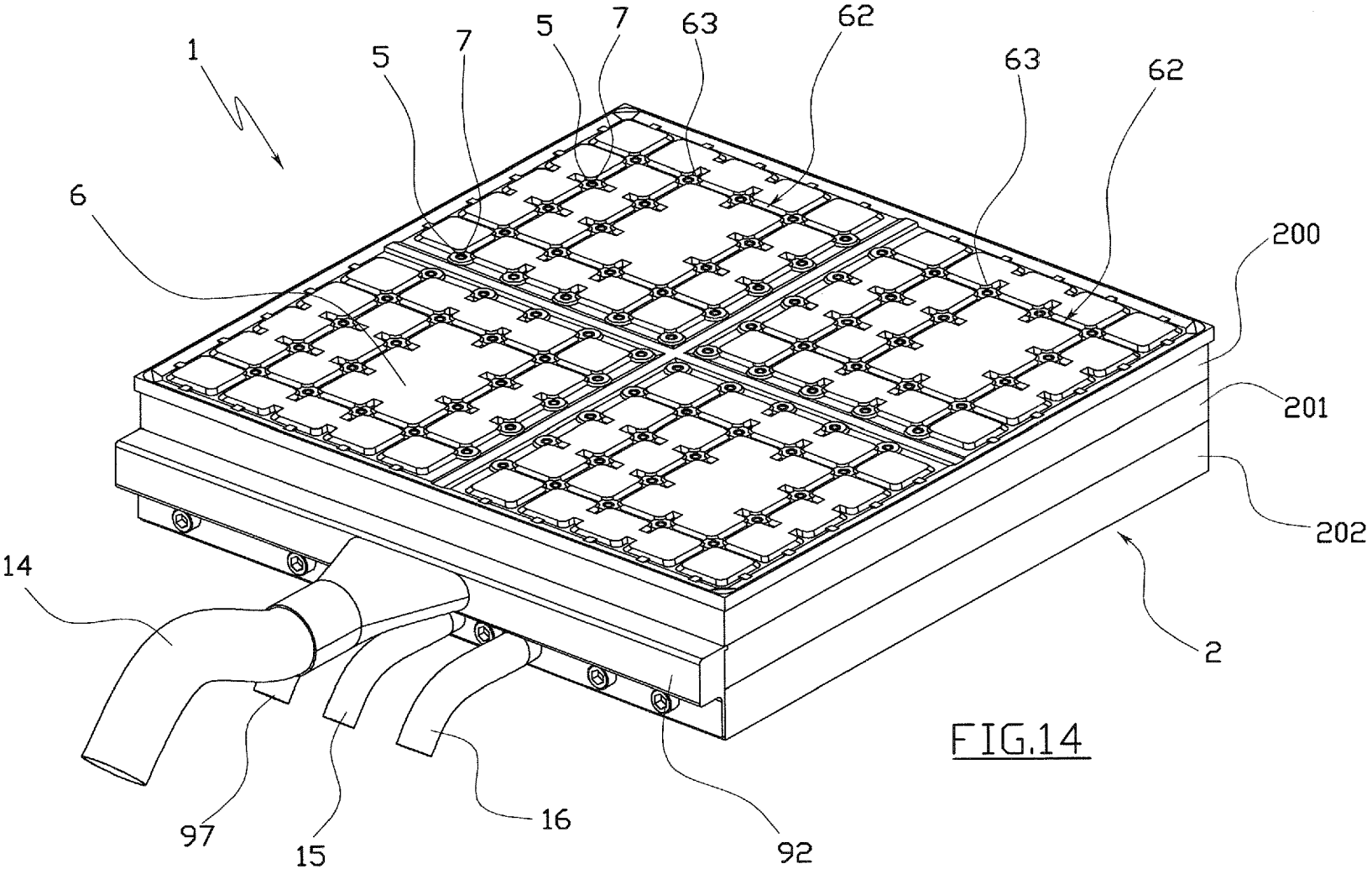
FIG. 14 is a perspective view of an isostatic die according to a third embodiment of the invention.
Figure 15:
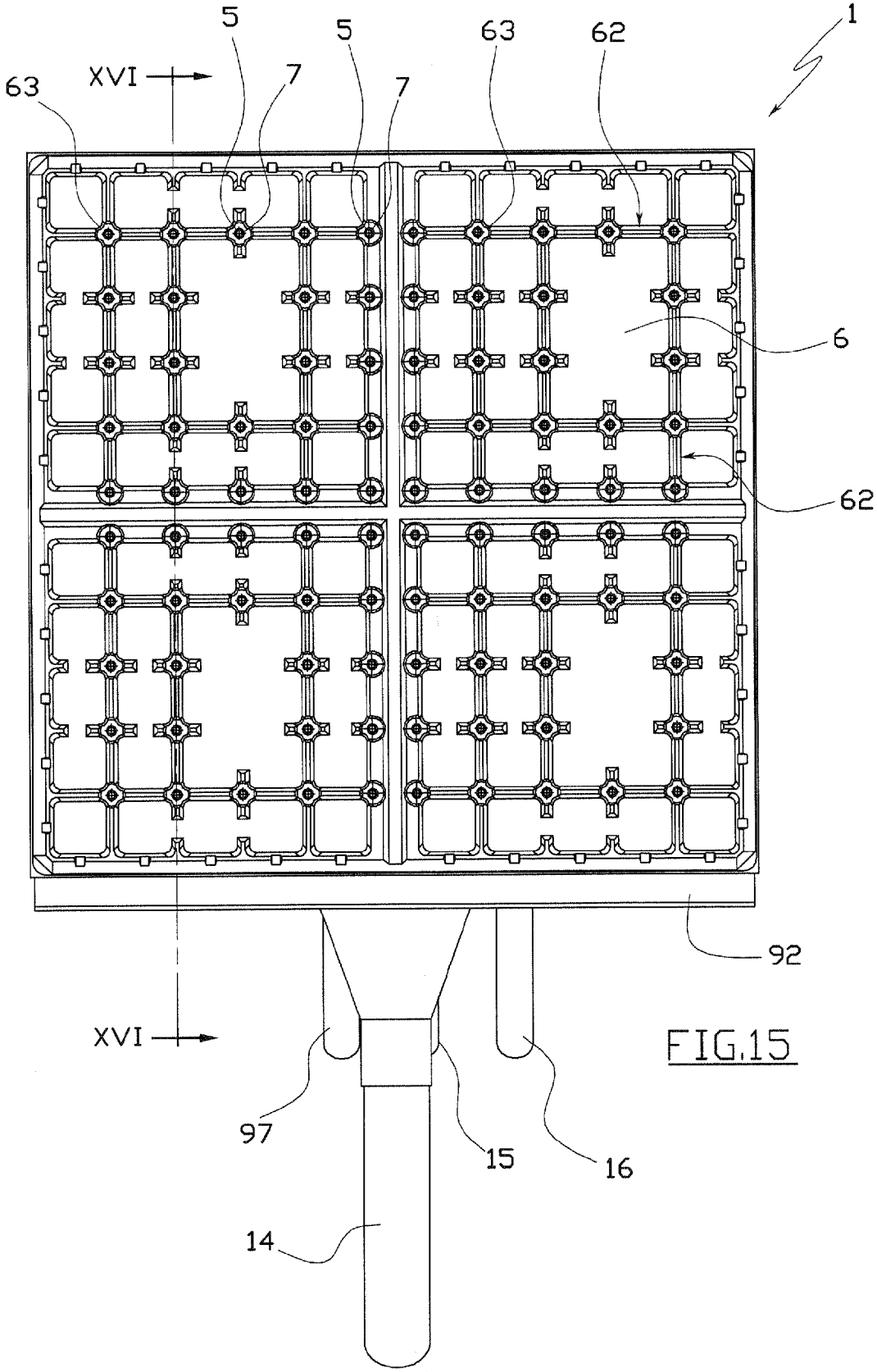
FIG. 15 is a plan view of the isostatic die of FIG. 14.

Note that FIG. 14 illustrates a conduit 15 for injecting the oil required for the isostatic pressing operation, and a conduit 16 for compressed air injection for activating the valve stems 70.

Figure 21:
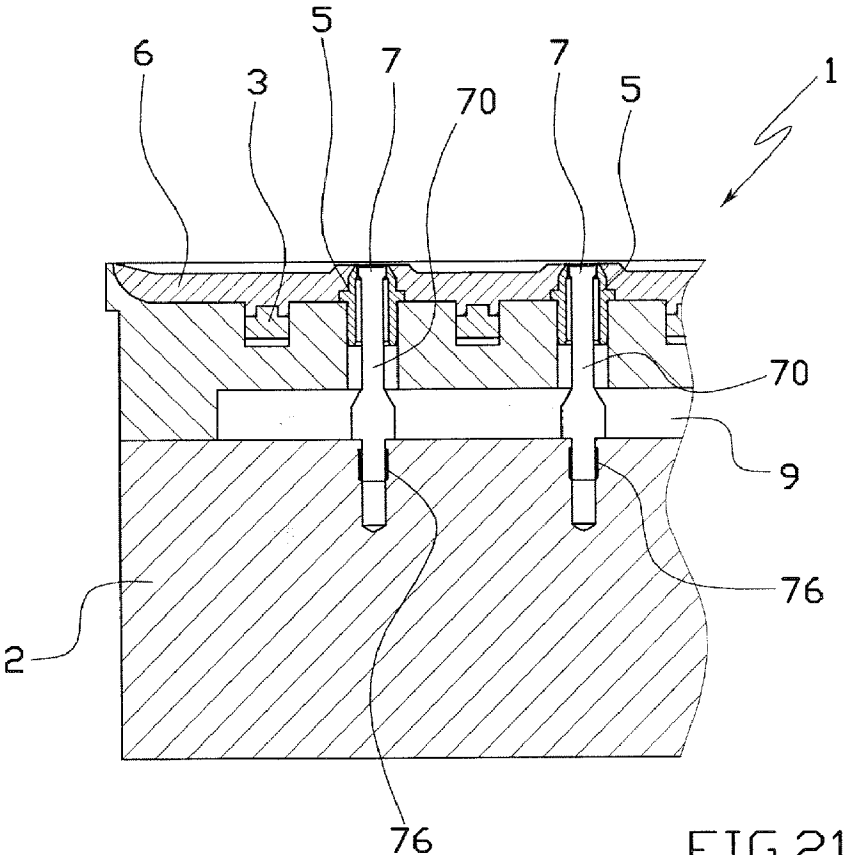
FIG. 21 is section XXI-XXI of FIG. 20.
Figure 20:
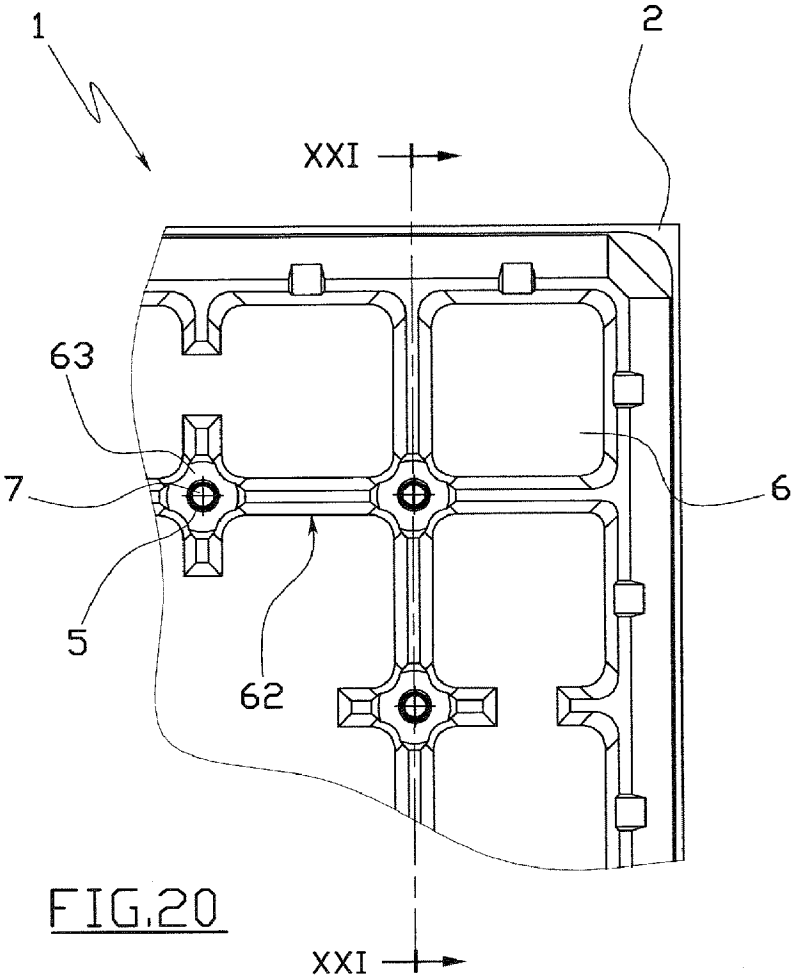
FIG. 20 is a detail in plan view of an isostatic die according to a fourth embodiment of the invention.

FIGS. 20 and 21 illustrate a fourth alternative embodiment of the invention. In this embodiment, the stems 70 are solidly fixed to the metal body 2 by means of a threaded sleeve 76, so that the valve bodies 7 are always still internally of the relative bushings 5, in the rest position.

The functioning of the isostatic die 1 is the same as the functioning of the die 1 described herein above.

However, in order to discharge the ceramic powder which might be trapped internally of the fissures between the valve bodies 7 and the mouths 5, the discharge conduits 9 are connected to a compressed-air blower device, in the same way as described for the previous embodiment.

The blower device enters into operation after each pressing cycle, so that the compressed air injected into the discharge conduits 9 tends to exit from breather mouths 52 and projects the trapped ceramic powder towards the forming cavity.

In order to perform this function, the blower device must however inject air into the discharge conduit 9 at a greater pressure than what is required in the third alternative embodiment of the invention.

Obviously an expert in the sector might bring numerous modifications or a technical-applicational nature to the isostatic dies described herein, without forsaking the ambit of the inventive idea as claimed herein below.

The invention claimed is:

1. An isostatic die for tile forming comprising a metal body (2) and an elastically deformable membrane (6, 6', 6") which is solidly gripped to the metal body (2) in a plurality of distinct predetermined fixing zones (25, 28, 290, 21, 22, 24', 24"), such that an intermediate hermetically-sealed chamber is delimited between the elastic membrane (6, 6', 6") and the metal body (2), which chamber is destined to contain an incompressible fluid, characterised in that rigid bushings (5, 5") are sunk into the elastic membrane (6, 6', 6"), each of which rigid bushings (5, 5") is located at a fixing zone (25, 28, 290, 21, 22, 24', 24") of the elastic membrane (6, 6', 6") to the metal body (2), and defines a breather mouth (52) which passes into a body of the elastic membrane (6, 6', 6") and which communicates with an outside environment through a system of discharge conduits (9) afforded in the metal body (2), each rigid bushing (5, 5") receiving a respective obturator body (7), which obturator body (7) enables passage of air and at least partially prevents passage of ceramic powder.

2. The die of claim 1, characterised in that each obturator body (7) is constituted by a compact body which partially obstructs the breather mouth (52) of the relative rigid bushing (5, 5"), leaving a narrow passage fissure perpetually open.

3. The die of claim 2, characterised in that the narrow fissure is of such a size as to enable passage of air during a pressing stage and to limit infiltration therein of the ceramic powder.

4. The die of claim 1, characterised in that the obturator body (7) is solidly fixed to the metal body (2) of the isostatic die, such as to be stationary with respect to the rigid bushing (5, 5").

5. The die of claim 1, characterised in that the obturator body (7) is associated to respective means for activating (70, 71, 41) which move the obturator body (7) alternatingly between a rest position, in which it is internal of the relative rigid bushing (5), and an extraction position in which it projects externally thereof.

6. The die of claim 5, characterised in that each obturator body (7) is fixed to an end of a valve stem (70) which valve stem (70) is slidable in a hole (4) which is afforded in the metal body (2) behind the respective rigid bushing (5).

7. The die of claim 6, characterised in that the valve stem (70) comprises a scraper body (75) which is coaxial to the obturator body (7) and is lo transversally larger, which scraper body (75) passes substantially snugly internally of the breather mouth (52), during displacement of the obturator body (7) from the rest position to the extraction position thereof, such as to push any ceramic powder which may be present in the breather body (52) in an externalwise direction.

8. The die of claim 6, characterised in that the means for activating comprise a portion of the valve stem (70) which, operating as a piston, is pushed by a pressurised fluid to slide internally of a relative cylindrical seating (41) afforded in the metal body (2).

9. The die of claim 8, characterised in that each valve body (7) is associated to means for recall (74) which return the valve body (7) to the rest position thereof.

10. The die of claim 9, characterised in that the means for recall comprise a spring (74) which acts on the piston in contrast to the pressurised fluid.

11. The die of claim 9, characterised in that the means for recall comprise an auxiliary hydraulic circuit which supplies pressurised fluid into the cylindrical seating (41) in order to push the piston in an opposite direction with respect to the extraction direction.

12. The die of claim 8, characterised in that the cylindrical seatings (41) of all the means for activating the valve bodies (7) are hydraulically connected through a same conveying conduit (8) of the pressurised fluid.

13. The die of claim 8, characterised in that the cylindrical seatings (41) of the means for activating the valve bodies (7) are hydraulically connected to a plurality of independent conduits (8) for conveying the pressurised fluid.

14. The die of claim 1, characterised in that each rigid bushing (5, 5") is inserted in a respective through-hole in the elastic membrane (6, 6', 6"), and exhibits a circumferential channel (51, 51") by which it couples with a rib (60, 60', 60") of the elastic membrane (6, 6', 6") which rib (60, 60', 60") projects from an internal wall of the through-hole.

15. The die of claim 1, characterised in that an end of the rigid bushing (5, 5") is in line with an active surface of the elastic membrane (6, 6', 6").

16. The die of claim 1, characterised in that the metal body (2) exhibits a hollow (23) conformed in plan view as a grid, in which a grid (3) of a suitable shape is housed, which grid (3) is more rigid than the elastic membrane (6) and is interposed between the elastic membrane (6) and the incompressible fluid chamber, each fixing zone (25) of the elastic membrane (6) to the metal body (2) being defined internally of a link of the grid-shaped hollow (23).

17. The die of claim 16, characterised in that the face of the elastic membrane (6) which is close to the grid (3) exhibits a grid in relief which snugly inserts in the hollow (23) of the metal body (2).

18. The die of claim 16, characterised in that the grid (3) is strongly gripped to the elastic membrane (6, 6', 6").

19. The die of claim 16, characterised in that the grid (3) is made of an elastomer material.

20. The die of claim 1, characterised in that each of the fixing zones comprises a grooved cavity (28) afforded in the metal body (2) in which a corresponding protuberance in relief of the elastic membrane (6') is snugly coupled.

21. The die of claim 1, characterised in that each of the fixing zones is delimited by a respective annular channel (290) afforded in the metal body (2), in which annular channel (290) a respective annular rib in relief of the elastic membrane (6") is snugly coupled.

22. The die of claim 1, characterised in that the discharge conduit system (9) is connected to an aspirating device, which aspirates any ceramic material possibly present in the discharge conduits (9).

23. The die of claim 1, characterised in that the discharge conduit (9) system is connected to a blower device, which injects pressurised air internally of the discharge conduits (9).

* * * * *